US010227167B2

(12) United States Patent
Darby et al.

(10) Patent No.: US 10,227,167 B2
(45) Date of Patent: Mar. 12, 2019

(54) DISPENSING ASSEMBLY

(71) Applicant: DS SMITH PLASTICS, LTD., London (GB)

(72) Inventors: Ian Darby, Leicestershire (GB); Paul N. Georgelos, Naperville, IL (US); Mark A. Smith, Plainfield, IL (US)

(73) Assignee: DS Smith Plastics, Ltd., London (GB)

( * ) Notice: Subject to any disclaimer, the term of this patent is extended or adjusted under 35 U.S.C. 154(b) by 16 days.

(21) Appl. No.: 14/897,405

(22) PCT Filed: Sep. 28, 2015

(86) PCT No.: PCT/IB2015/002107
§ 371 (c)(1),
(2) Date: Dec. 10, 2015

(87) PCT Pub. No.: WO2016/051276
PCT Pub. Date: Apr. 7, 2016

(65) Prior Publication Data

US 2018/0079564 A1 Mar. 22, 2018

Related U.S. Application Data

(60) Provisional application No. 62/111,336, filed on Feb. 3, 2015.

(30) Foreign Application Priority Data

Sep. 29, 2014 (GB) ..... 1417128.4

(51) Int. Cl.
*B65D 47/06* (2006.01)
*B65D 77/06* (2006.01)
*B65D 85/80* (2006.01)

(52) U.S. Cl.
CPC ..... *B65D 47/068* (2013.01); *B65D 77/065* (2013.01); *B65D 77/067* (2013.01); *B65D 85/80* (2013.01)

(58) Field of Classification Search
CPC .... B65D 47/068; B65D 77/067; B65D 85/80; B65D 77/065
See application file for complete search history.

(56) References Cited

U.S. PATENT DOCUMENTS 4,375,864 A * 3/1983 Savage ..... B65D 77/067 222/81
4,948,014 A 8/1990 Rutter et al.
(Continued)

FOREIGN PATENT DOCUMENTS

BR 2009PI14468 10/2015
CA 2577905 3/2006
(Continued)

OTHER PUBLICATIONS

Patent Cooperation Treaty, Invitation to Pay Additional Fees and, Where Applicable, Protest Fee; and Communication Relating to the Results of the Partial International Search, Application No. PCT/IB2015/002107, dated Feb. 17, 2016 (7 pages).
(Continued)

*Primary Examiner* — Frederick C Nicolas
*Assistant Examiner* — Bob Zadeh
(74) *Attorney, Agent, or Firm* — McAndrews, Held & Malloy, Ltd.

(57) ABSTRACT

A dispensing assembly for a liquid container including a ring part configured to be mounted to a liquid container, a resilient member positioned in the ring part to be in contact with the liquid contents of the liquid container, a ring member mountable to the ring part to secure the resilient member to the ring part, and a hollow connecting member
(Continued)

with an outlet. The connecting member is releasably securable to the ring member and includes a hollow projecting member which, when the connecting member is secured to the ring member, engages the resilient member so as to urge an opening in the resilient member to permit liquid in the container to pass into the connecting member and subsequently out through the outlet.

36 Claims, 20 Drawing Sheets

(56) References Cited

U.S. PATENT DOCUMENTS

| | | | | |
|---|---|---|---|---|
| 5,111,970 | A | 5/1992 | Rutter et al. | |
| 5,494,196 | A * | 2/1996 | Tyner | A61J 1/10 215/256 |
| 5,609,195 | A * | 3/1997 | Stricklin | F16L 37/28 137/614.04 |
| 5,697,410 | A | 12/1997 | Rutter et al. | |
| 5,740,945 | A | 4/1998 | Shipway | |
| 5,901,761 | A | 5/1999 | Rutter et al. | |
| 5,983,964 | A | 11/1999 | Zielinksi et al. | |
| 6,021,923 | A | 2/2000 | Shipway | |
| 6,070,624 | A | 6/2000 | Bilbrey et al. | |
| D440,631 | S | 4/2001 | Shipway | |
| 6,595,391 | B1 | 7/2003 | Anderson | |
| 6,612,545 | B1 | 9/2003 | Rutter et al. | |
| 6,702,337 | B2 | 3/2004 | Rutter et al. | |
| 6,893,000 | B2 | 5/2005 | Rutter et al. | |
| 6,971,548 | B2 | 12/2005 | Smith | |
| 7,543,723 | B2 | 6/2009 | Wilford et al. | |
| 7,607,555 | B2 * | 10/2009 | Smith | B65D 77/067 215/257 |
| 8,091,864 | B2 | 1/2012 | Smith | |
| 8,397,958 | B2 | 3/2013 | Smith et al. | |
| 8,413,857 | B2 * | 4/2013 | Johnson | B65D 75/5877 222/105 |
| 8,448,820 | B2 * | 5/2013 | Johnson | B65D 77/067 222/490 |
| 8,820,591 | B2 | 9/2014 | Smith et al. | |
| 8,944,094 | B2 | 2/2015 | Johnson | |
| 8,973,789 | B2 * | 3/2015 | Smith | B65D 47/2031 222/105 |
| 9,010,589 | B2 | 4/2015 | Thurman et al. | |
| 9,033,311 | B2 | 5/2015 | Smith | |
| 9,079,694 | B2 | 7/2015 | Arch et al. | |
| 9,434,516 | B2 | 9/2016 | Johnson | |
| 9,573,736 | B2 * | 2/2017 | Arch | B65D 47/068 |
| 9,592,944 | B2 | 3/2017 | Johnson | |
| 9,604,836 | B2 * | 3/2017 | Nini | B67D 3/043 |
| 9,862,588 | B2 | 1/2018 | Johnson | |
| 2008/0245816 | A1 | 10/2008 | Armstrong et al. | |
| 2010/0176152 | A1 * | 7/2010 | Johnson | B65D 75/5877 222/92 |
| 2010/0296858 | A1 | 11/2010 | Richards et al. | |
| 2011/0248054 | A1 | 10/2011 | Darby | |
| 2011/0272405 | A1 | 11/2011 | Thurman et al. | |
| 2011/0309279 | A1 | 12/2011 | Richards et al. | |
| 2012/0031923 | A1 * | 2/2012 | Smith | B65D 47/2031 222/83 |
| 2012/0187158 | A1 * | 7/2012 | Pritchard | B65D 47/103 222/501 |
| 2012/0223095 | A1 | 9/2012 | Smith | |
| 2013/0126561 | A1 | 5/2013 | Smith et al. | |
| 2014/0209643 | A1 | 7/2014 | Smith et al. | |
| 2015/0028065 | A1 | 1/2015 | Arch et al. | |
| 2015/0307236 | A1 | 10/2015 | Bellmore et al. | |
| 2016/0009457 | A1 | 1/2016 | Arch et al. | |
| 2016/0009462 | A1 | 1/2016 | Erickson et al. | |
| 2016/0107807 | A1 | 4/2016 | Fan et al. | |
| 2016/0178103 | A1 | 6/2016 | Murray et al. | |
| 2017/0001771 | A1 | 1/2017 | Oostveen | |
| 2017/0121168 | A1 | 5/2017 | Johnson | |
| 2018/0079564 | A1 * | 3/2018 | Darby | B65D 47/068 |

FOREIGN PATENT DOCUMENTS

| | | |
|---|---|---|
| CA | 2741643 | 4/2010 |
| EP | 2479118 | 7/2012 |
| EP | 2691335 | 1/2016 |
| EP | 2709922 | 4/2016 |
| EP | 2057403 | 5/2016 |
| WO | WO2010080897 | 7/2010 |
| WO | WO2012150937 | 11/2012 |
| WO | WO2015026800 | 2/2015 |
| WO | 2017004148 | 1/2017 |

OTHER PUBLICATIONS

Patent Cooperation Treaty, Notification Concerning Transmittal of International Preliminary Report on Patentability and the Written Opinion of the International Searching Authority, Application No. PCT/IB2015/002107, dated Apr. 13, 2017 (12 pages).

Patent Cooperation Treaty, Notification of Transmittal of the International Search Report and the Written Opinion of the International Searching Authority, or the Declaration, Application No. PCT/IB2015/002107, dated Apr. 25, 2016 (18 pages).

* cited by examiner

DISPENSING ASSEMBLY

RELATED APPLICATIONS

This application makes reference and claims priority to U.S. Provisional Patent Application No. 62/111,336, filed on Feb. 3, 2015 and titled "Dispensing Assembly," and to Great Britain Patent Application No. 1417128.4, filed on Sep. 29, 2014 and titled "Dispensing Assembly." U.S. Provisional Patent Application No. 62/111,336 and Great Britain Patent Application No. 1417128.4 are hereby incorporated by reference herein in their entireties.

BACKGROUND OF THE INVENTION

This invention concerns a dispensing assembly, a dispensing arrangement, and a container assembly of liquid.

It is often required to provide a supply of a liquid such as milk to a drinks dispensing machine such as a coffee machine or otherwise. Previously this has often been achieved by filling a part of the machine with for instance milk. In view of the relatively short shelf life of liquids such as milk, it is appropriate for such parts of the machine to be regularly emptied and thoroughly washed out. There is however a tendency for such parts to simply just be regularly topped up with milk. This can lead to unhygienic operating conditions, and for instance bacterial build up.

SUMMARY OF THE INVENTION

According to a first aspect of the invention there is provided a dispensing assembly for a liquid container which container has an opening configuration with a resilient membrane with an opening therein which in a rest position will automatically close, but can be urged to an open position providing access to the interior of the container, the assembly comprising a ring member mountable on such a container such that access can be obtained therethrough to the resilient member, and a hollow connecting member with an outlet, which connecting member is releasably securable to the ring member, the connecting member including a hollow projecting member which when the connecting member is secured to a ring member mounted on such a container, engages with the resilient member so as to urge the opening therein to an open position to permit liquid in the container to pass into the connecting member and subsequently out through the outlet.

The ring member may be configured such that the connecting member can be secured thereto in more than one orientation.

The ring member may have one or more bayonet fittings thereon, with a projection on the connecting member engageable in the bayonet fitting or in one of the bayonet fittings.

A plurality of projections may be provided on the connecting member engageable simultaneously with respective bayonet fittings on the ring member, and two substantially diametrically opposite projections may be provided on the connecting member.

A plurality of diametrically opposite bayonet fittings may be provided on the ring member, and two substantially equispaced pairs of diametrically opposite bayonet fittings may be provided on the ring member.

The bayonet fitting or fittings may include a retaining formation to retain a projection therein.

The outlet may include a formation to retain a pipeline connected thereto.

A plug member may be provided mountable to the ring member. A handle may be provided on the plug member to facilitate removal thereof from the ring member.

According to a second aspect of the invention there is provided a dispensing arrangement for a liquid container, the arrangement including a ring part mountable to the container to surround an opening therein, a resilient material diaphragm with an opening therein which in a rest position will automatically close, but can be urged to an open position providing access to the interior of the container, the diaphragm extending across the ring part, and a dispensing assembly according to any of the preceding claims mounted to the ring part.

The dispensing assembly may retain the diaphragm in position on the ring part. The ring member may retain the diaphragm in position on the ring part.

The ring member may engage with the ring part, and respective threads may be provided such that the ring member threadingly engages with the ring part.

According to a third aspect of the invention there is provided a container assembly of liquid, the assembly comprising a container with a ring part and diaphragm as defined according to any of the preceding paragraphs.

The container assembly may include a ring member according to any of the preceding paragraphs.

The container assembly may include a plug member according to any of the preceding paragraphs, and after filling of the assembly with liquid, the plug member may initially be mounted to the ring member by a frangible connection.

After filling of the assembly with liquid, a removable tear off seal may initially be provided extending across the outside of the ring part.

The container assembly may be in the form of a bag in box container.

Certain aspects of the present invention provide a dispensing assembly for a liquid container including a ring part configured to be mounted to a liquid container, a resilient member positioned in the ring part to be in contact with the liquid contents of the liquid container, a ring member mountable to the ring part to secure the resilient member to the ring part, and a hollow connecting member with an outlet. The connecting member is releasably securable to the ring member and includes a hollow projecting member which, when the connecting member is secured to the ring member, engages the resilient member so as to urge an opening in the resilient member to permit liquid in the container to pass into the connecting member and subsequently out through the outlet.

The resilient member may be partially scored.

The connecting member may include at least one barb member on the projecting member, and the ring member may include an annular flange. When the connecting member is secured to the ring member, the barb member is positioned beneath the annular flange and the annular flange resists upward movement by the barb member.

The projecting member of the connecting member may include a first hollow body having a first slot and a second hollow body having a second slot. The second body slidably receives the first body, and, when the connecting member is connected to the ring member, the first body is rotatable with respect to the second body between (i) a first position where the first and second slots overlap and allow for fluid in the container to enter the connecting member, and (ii) a second position where the first and second slots do not overlap.

The projecting member of the connecting member may include a first hollow body having a first slot, a second hollow body having a second slot and an opening at a bottom end, and a seal member having a knob positioned in the first slot and a tab positioned in the second slot. The second body slidably receives the first body, and, when the connecting member is connected to the ring member, the seal member can slide along the first and second slots with respect to the first and second bodies, respectively, to (i) a first position where the seal member seals the bottom end of the second body to prevent liquid from entering the second body, and (ii) a second position where the seal member does not seal the bottom end of the second body and liquid can enter the second body.

Certain aspects of the present invention provide a dispensing assembly for a liquid container. The assembly includes a ring part configured to be mounted to a spout of a liquid container, a partially scored but non perforated resilient member positioned in the ring part to be in contact with the liquid contents of the liquid container, a ring member mountable to the ring part to secure the resilient member to the ring part and having channels defined by projections extending inwardly from a collar of the ring member, and a hollow connecting member having an outlet, a hollow projecting member, and tabs. The connecting member is releasably securable to the ring member by rotating the connecting member with respect to the ring member such that the tabs are secured in the channels of the ring member. When the connecting member is secured to the ring member, the projecting member engages the resilient member so as to urge an opening in the resilient member to permit liquid in the container to pass into the connecting member and subsequently out through the outlet, and the opening in the resilient member automatically closes when the connecting member is detached from the ring member.

Certain aspects of the present invention provide a dispensing assembly for a liquid container. The assembly includes a ring part configured to be mounted to a spout of a liquid container, a resilient member with an opening therein which in a rest position will automatically close and that can be urged to an open position providing access to the interior of the container, a ring member mountable on the ring part such that access can be obtained to the container through the resilient member, and a hollow connecting member with an outlet. The connecting member is releasably securable to the ring member and includes a hollow projecting member which, when the connecting member is secured to the ring member, engages with the resilient member so as to urge the opening therein to an open position to permit liquid in the container to pass into the connecting member and subsequently out through the outlet.

BRIEF DESCRIPTION OF THE DRAWING(S)

Embodiments of the present invention will now be described by way of example only and with reference to the accompanying drawings, in which.

Figure 1:
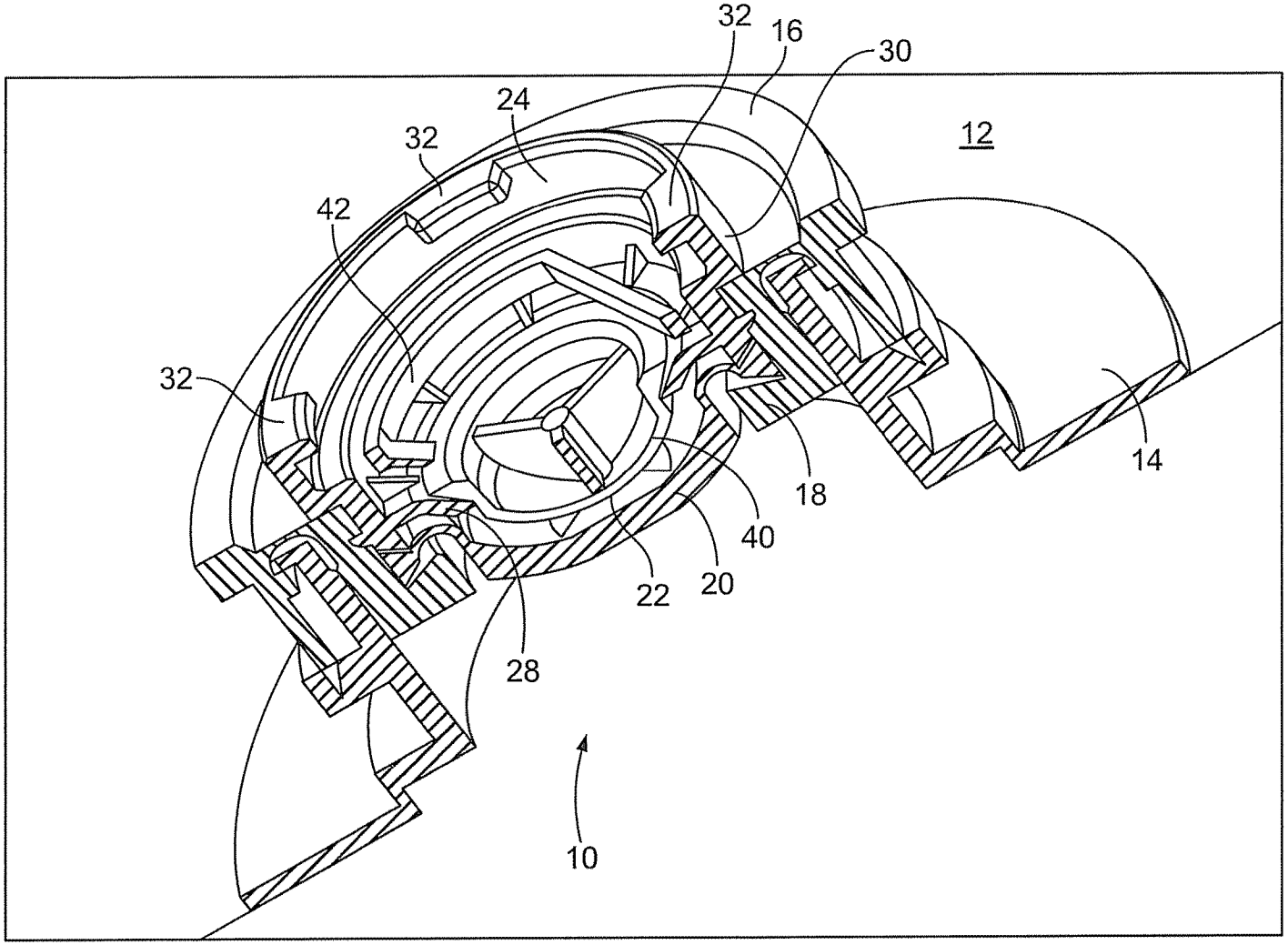
FIG. 1 is a diagrammatic perspective sectional view of part of a dispensing assembly according to the invention.

The foregoing summary, as well as the following detailed description of embodiments of the present invention, will be better understood when read in conjunction with the appended drawings. For the purpose of illustrating the invention, certain embodiments are shown in the drawings.

It should be understood, however, that the present invention is not limited to the arrangements and instrumentalities shown in the attached drawings.

DETAILED DESCRIPTION OF EMBODIMENTS OF THE INVENTION

The drawings show a dispensing arrangement 10 for a liquid container such as a bag in a box arrangement for holding milk. Part of such a container 12 is shown in FIG. 1 with a spout 14. The arrangement 10 comprises a ring part 16 mountable on the spout 14 in a conventional arrangement. The ring part 16 provides an inwardly facing annular flange 18 on which sits a resilient membrane 20 which may be made for example of silicone. The membrane 20 has an opening configuration such as for example a cruciform or star shaped opening 22 provided centrally in it. The membrane 20 is configured such that in a rest position the opening configuration will remain closed thereby providing a seal for the arrangement 10.

Figure 5:
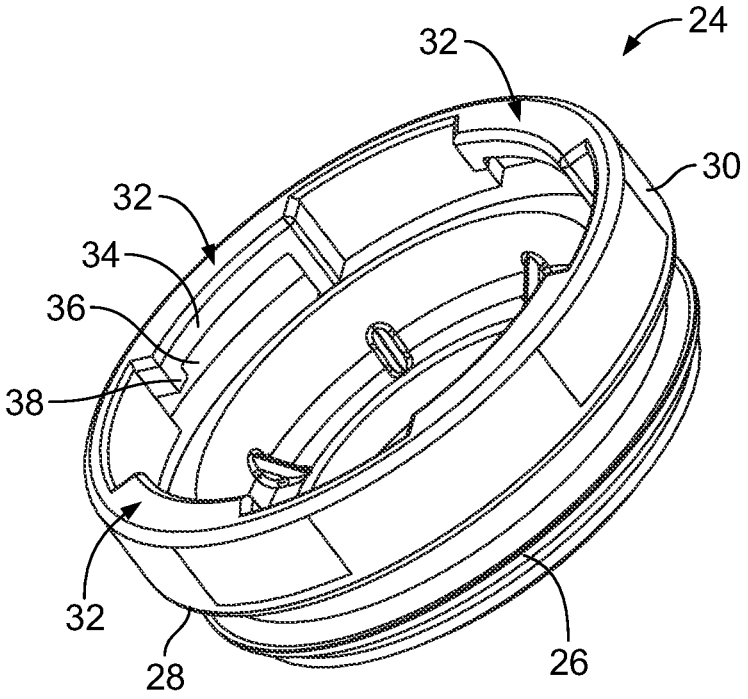
FIG. 5 is a diagrammatic perspective view of a component of the assembly shown in FIG. 1.

A ring member 24 is provided which locates inside the ring part 16 and is a snap fit therein with a plurality of annular projections 26 on the ring member 24, which can be seen for instance in FIG. 5. The ring member 24 provides an inwardly turned annular flange 28 which holds the edge of the resilient membrane 20 in position against the annular flange 18 of the ring part 16.

Figure 2:
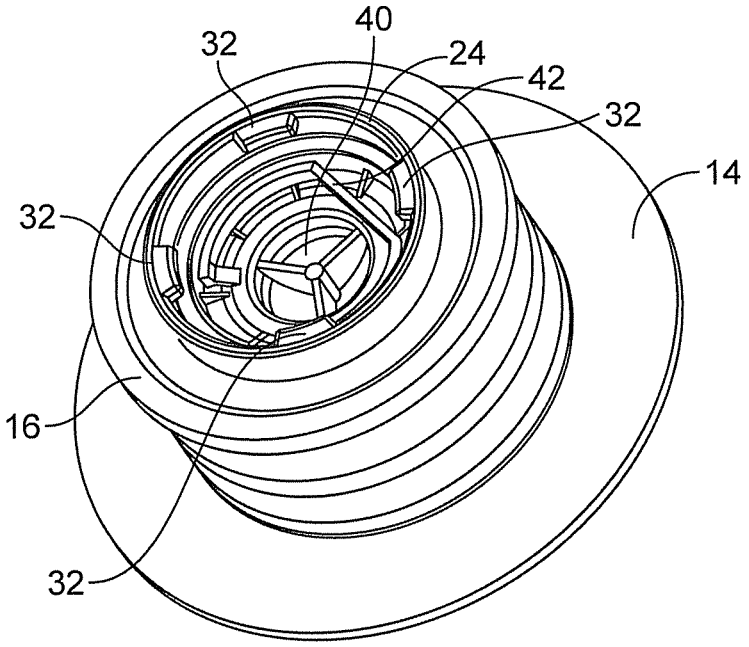
FIG. 2 is a diagrammatic perspective view of the part of the dispensing assembly of FIG. 1.
Figure 3:
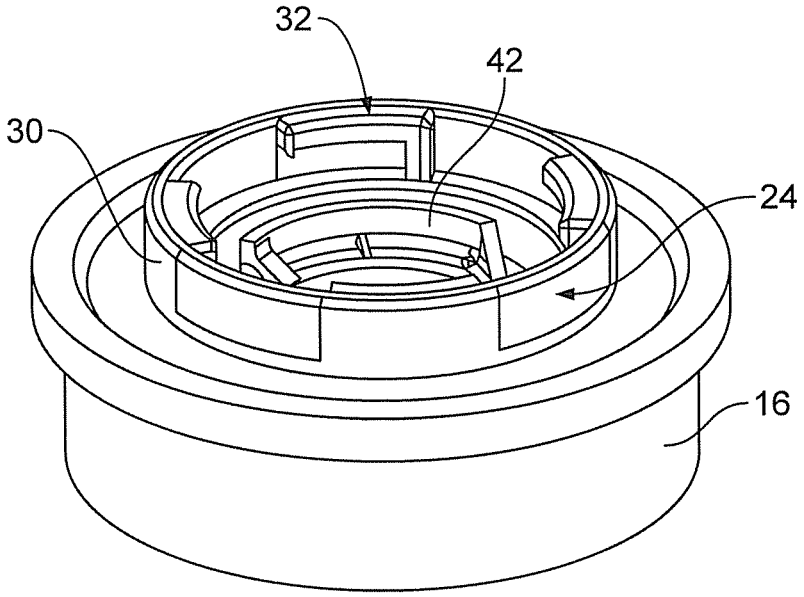
FIG. 3 is a diagrammatic perspective view of part of the assembly of FIG. 1.
Figure 4:
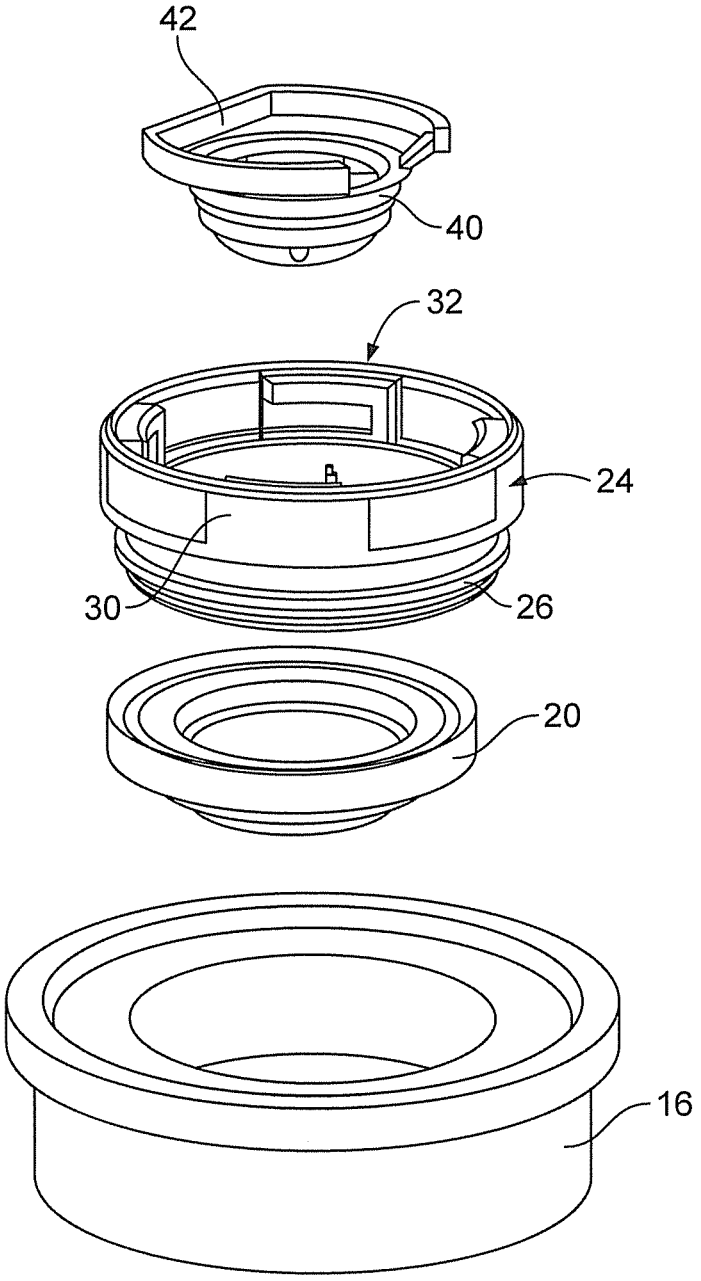
FIG. 4 is a diagrammatic exploded perspective view of the part of the assembly shown in FIG. 2.

The ring member 24 provides a cylindrical collar part 30 with four equispaced bayonet fittings 32 which are not shown in detail in FIGS. 1 and 2. The bayonet fittings 32 comprise an L shaped inwardly extending transversely arranged projection 34 defining a channel 36. A downwardly extending retaining projection 38 is provided on the free end of the stem of the L shaped projection 34 to retain items in the channel 36.

When in the fully closed position after filling, the container has a plug member 40 which extends across the interior of the ring member 24. The plug member 40 is attached to the ring member 22 by a frangible connection, and a loop 42 is provided on the plug member 40 which can be pulled upwardly and used to manually break the frangible connection to remove the plug member 40 from the ring member 24. Alternatively, the plug member 40 can be connected to the ring member 22 by a press fit so that the plug member 40 can be snapably attached to and detached from the ring member 22. This allows a user to reattach the plug member 40 to the ring member 22 after detaching the plug member 40.

A tear off membrane can be provided after filling of the container 12 extending across the top of the ring member 24. The container 12 will be supplied with the membrane in place, but this can be torn off when it is required to first access the contents of the container 12.

Figure 6:
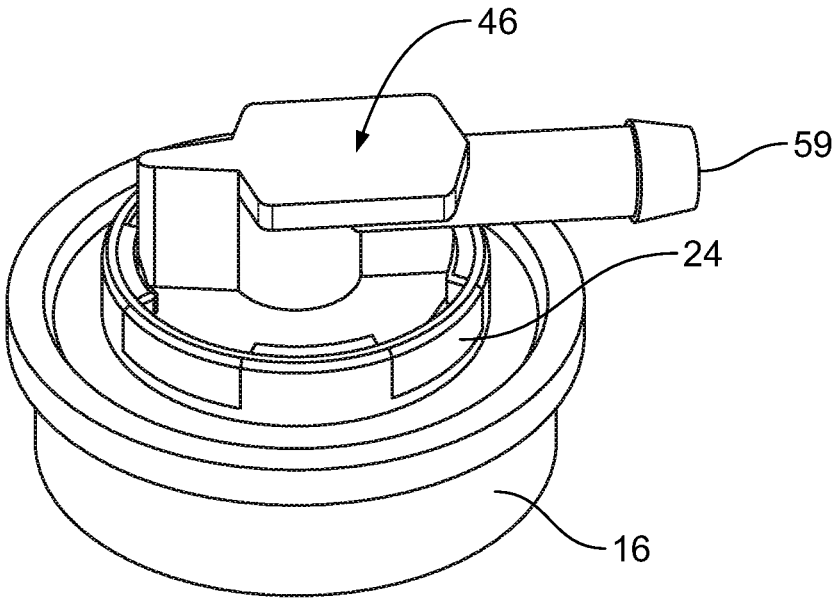
FIG. 6 is a diagrammatic perspective view of part of the assembly of FIG. 1.
Figure 7:
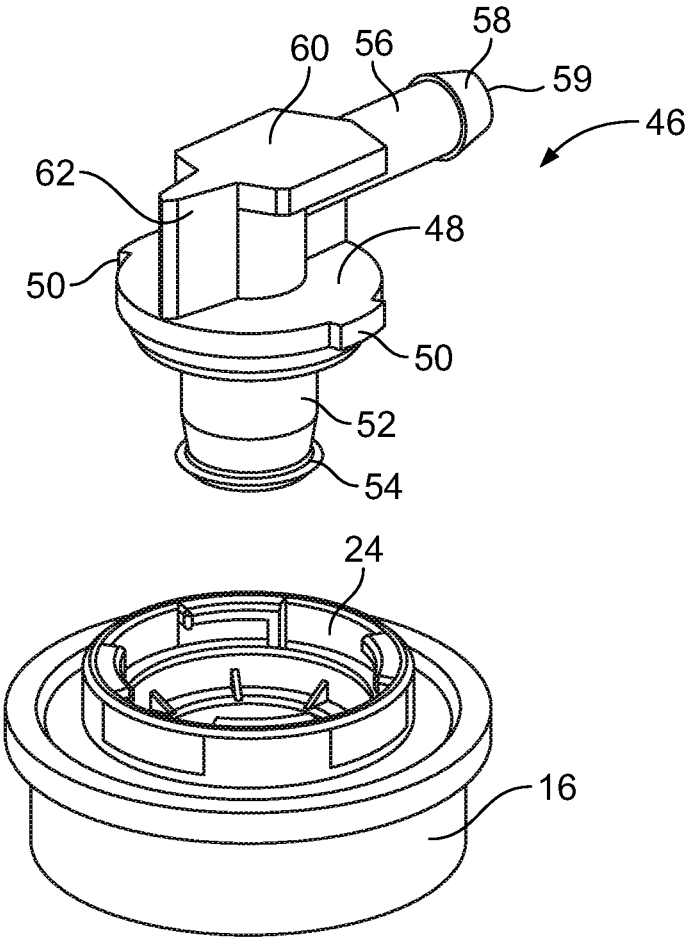
FIG. 7 is a diagrammatic exploded perspective view of the components shown in FIG. 6.

A hollow connecting member 46 is also provided as shown in FIGS. 6 and 7. The connecting member 46 includes a circular base 48 with two diametrically opposite radially extending tabs 50, which tabs 50 are of a size to fit within the channels 36. Extending from one side, which is the lower side as shown in FIG. 6, of the base 48, is a hollow projecting member 52 with a distal rim 54. The projecting member 52 is of a size to fit through the ring member 24.

On the opposite side of the base 46 a radially extending tube 56 is provided with a slightly enlarged head 58. The connecting member 46 includes an outlet 59. A smaller plate 60 is provided above the tube 56 with a tab 62 extending in a diametrically opposite direction to the tube 56, with the plate 60 and tab 62 facilitating manual movement and rotation of the connecting member 46.

After filling of the container 12 it should be supplied in the form as shown in FIG. 1. When it is required to access the contents of the container 12, the membrane can be torn off and discarded. The plug member 40 can then be removed by breaking the frangible seal between the plug member 40 and the ring member 24 using the loop 42 if required.

The connecting member 46 can now be located in the ring member 24, with the tabs 50 engaging with either pair of bayonet fittings 32. The connecting member 46 can be pushed downwardly and rotated until the tabs 50 locate in their respective channels 36. The resilient membrane 20 will urge the connecting member 46 outwardly such that the tabs 50 will be held in the channels 36 by the retaining projections 38 to prevent any inadvertent disconnection.

The projecting member 52 will urge the opening 22 in the resilient membrane 20 open, such that liquid will flow from the container 12 through the connecting member 46 into the tube 56. An appropriate pipe or otherwise will have been connected to the tube 56 and the enlarged head 58 will help to retain such a pipe in position.

When it is required to disconnect the connecting member 46 from the container 12, the connecting member 46 can be pushed against the reactive force from the resilient membrane 20 such that the tabs 50 can be rotated past the retaining projections 38. The connecting member 46 can now be moved away from the container 12. As the projecting member 52 moves away from the resilient membrane 20, this will automatically close. The connecting member 46 and any connecting pipework can then be cleaned prior to subsequent reuse.

The above described arrangement means that for instance a bag in box container for milk can be used. The connecting member can readily be disconnected therefrom to permit regular cleaning whilst the container will automatically close. Use of a container such as a bag in box container means that aseptic conditions can be used with the milk. The provision of the two pairs of bayonet fittings mean that the connecting member can readily be fitted irrespective of the alignment of the ring member on the container.

Figure 8:
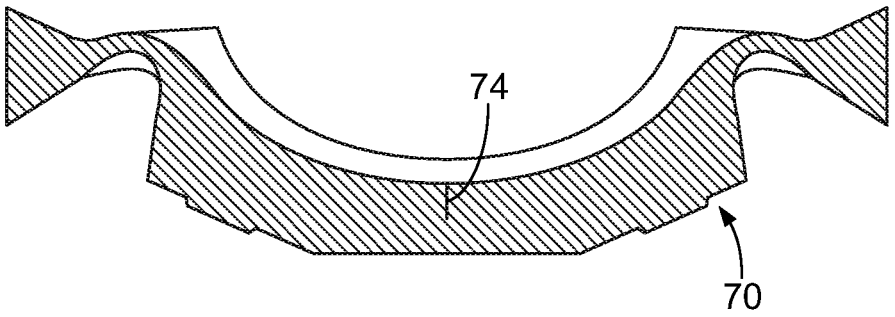
FIG. 8 illustrates a cross sectional side view of a membrane according to an embodiment of the present invention.

FIG. 8 illustrates a cross-sectional side view of an alternative embodiment of a membrane 70 that can be used with the dispensing arrangement 10 (FIG. 1). The membrane 70 includes a partial score 74 that does not extend all the way through the membrane 70. Accordingly, the membrane 74 is not completely perforated and does not have an opening. Therefore, when the partially scored membrane 70 is positioned in the ring member 24 (FIG. 1) of the dispensing arrangement 10 and the dispensing arrangement 10 is connected to the spout 14 (FIG. 1) of the container 12 (FIG. 1), the membrane 70 provides an aseptic barrier or seal between the spout 14 and the outside environment. The partial score 74 on the membrane 70 can form a star or cruciform shape. Alternatively, the score 74 can form other shapes and have other orientations. The membrane 70 is made of a flexible and resilient material such as silicone. By way of example only, the membrane 70 may be between 20-25 mils thick and, at the score 74, the unscored portion of the membrane 70 may only be 1-4 mils thick. Therefore, for a membrane 70 that is 20 mils thick, the score 74 may extend within a range of 16-19 mils into the membrane 70 and the unscored portion of the membrane 70 below the score may be 1-4 mils thick.

When the connecting member 46 (FIG. 7) is connected to the ring member 24 as discussed above, the projecting member 52 (FIG. 7) will cause the partial scores 74 in the membrane 70 to extend through the membrane material to become complete scores and create an opening in the membrane 74 such that liquid will flow from the container 12 through the projecting member 52 (FIG. 7) of the connecting member 46. When the connecting member 46 is detached from the dispensing arrangement 10, the projecting member 52 is pulled away from the membrane 70, and the membrane 70 automatically closes.

Figure 9:
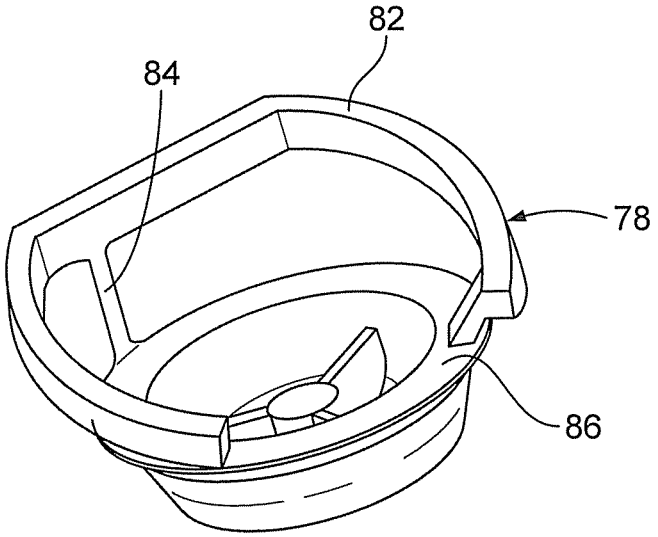
FIG. 9 illustrates an isometric view of a plug member according to an embodiment of the present invention.

FIG. 9 illustrates an isometric view of a plug member 78 according to an embodiment of the present invention. The plug 78 is similar to the plug member 40 of FIGS. 1-4, but the flexible loop 82 extends higher above a base 86 of the plug member 78. The plug member 78 includes a frangible vertical connecting portion 84 that extends from the base 86 to the loop 82. The connecting portion 84 is broken the first time user pulls the loop 82 upward to remove the plug member 78 from the ring member 24 (FIG. 1). Breaking the connecting portion 84 allows the user to bend the loop 82 further upward and extend his or her finger underneath the loop 82 as necessary to pull the plug member 78 out of the ring member 24.

Figure 10:
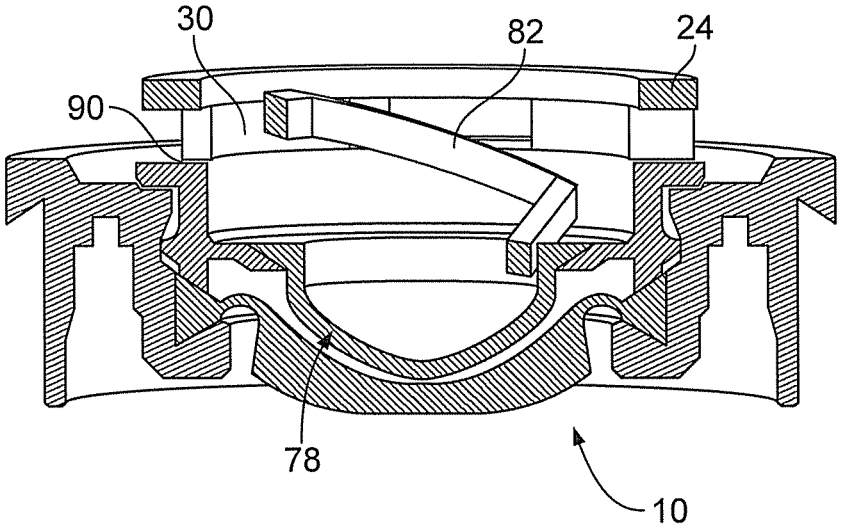
FIG. 10 illustrates a cross sectional side view of the plug member of FIG. 9 mounted to a dispensing arrangement.

FIG. 10 illustrates a cross-sectional view of the plug member 78 mounted to the ring member 24 of the dispensing arrangement 10. The plug member 78 may be attached or mounted to the ring member 24 by a frangible connection, snapable connection, or a press fit. The collar 30 of the ring member 24 extends upwardly from a ledge 90. When the plug member 78 is mounted to the ring member 24, the loop 82 extends up above the ledge 90 but does not extend above the collar 30. Alternatively, the loop 82 can extend up to a point above the collar 30 of the ring member 24. The elevated loop 82 of the plug member 78 allows for a user to easily extend his or her finger under the loop 82 in order to better grip the loop 82 and pull the plug member 78 out of the ring member 24.

Figure 11:
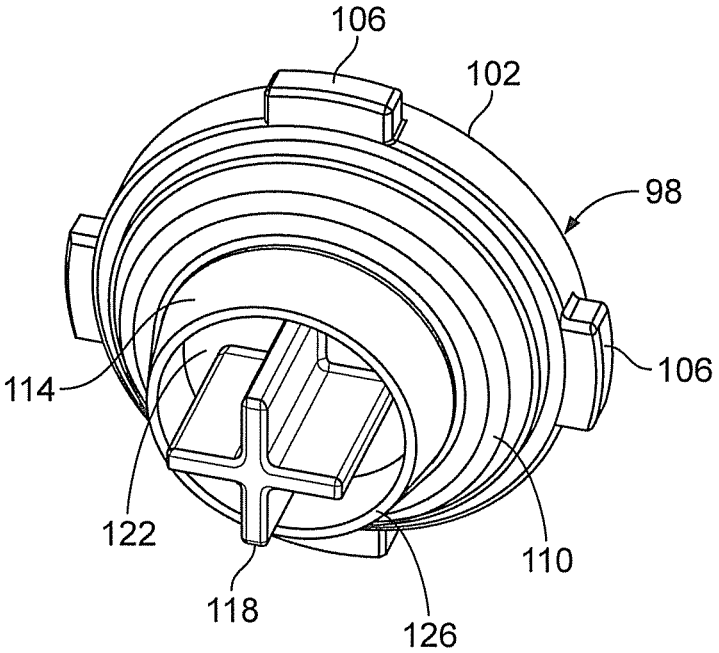
FIG. 11 illustrates a bottom isometric view of a plug member according to an embodiment of the present invention.

FIG. 11 illustrates an alternative embodiment of a plug member 98 for use with the dispensing arrangements 10 of FIGS. 1-7 and 10. The plug member 98 is configured to fit inside the ring member 24 (FIG. 1) of the dispensing arrangement 10. The plug member 98 has a circular top portion 102 from which tabs 106 extend radially outward. By way of example only, the plug member 98 includes four tabs 106. The tabs 106 are configured to be received in the channels 36 (FIG. 5) of the bayonet fittings 32 (FIG. 5) of the ring member 24 and held in place in the channels 36 by the retaining projections 38 (FIG. 5) of the bayonet fittings 32. A rounded or bowl-shaped wall 110 extends downward from the top portion 102 and curves inward as it extends further downward from the top portion 102. A cylindrical seal wall 114 extends downward from the rounded wall 110. A cross shaped boss 118 is located inside of the seal wall 114 and extends from a bottom 122 of the rounded wall 110 out past a bottom edge 126 of the seal wall 114. Alternatively, the boss 118 can have other shapes.

Figure 12:
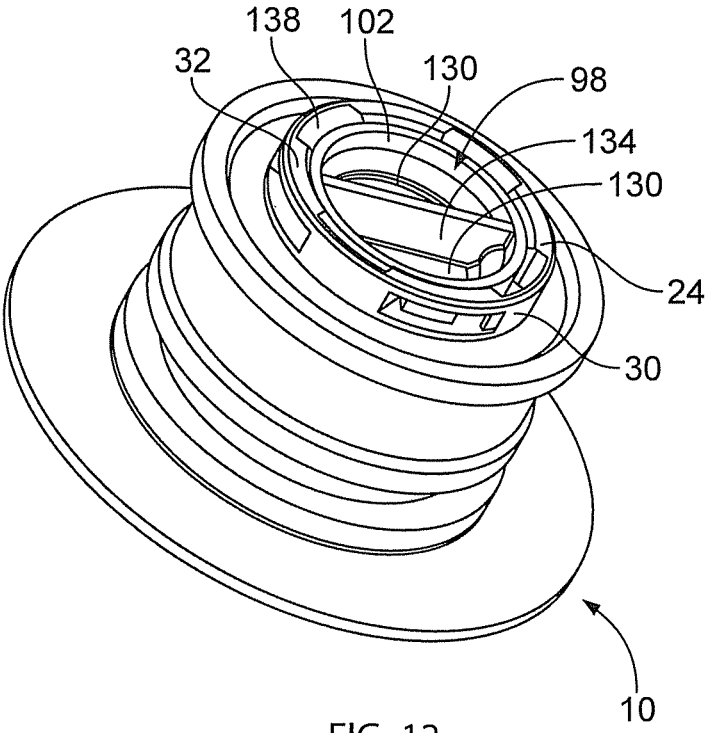
FIG. 12 illustrates a top isometric view of the plug member of FIG. 11 mounted to a dispensing arrangement.

FIG. 12 illustrates the plug member 98 connected to the ring member 24 of the dispensing arrangement 10. The top portion 102 of the plug member 98 includes two half circle shaped cavities 130 that are divided by a vertical grip portion 134. A user inserts his or her thumb and fingers into the cavities 130 and grips the grip portion 134 between a thumb and a finger in order to connect the plug member 98 to the ring member 24. In particular, the user vertically aligns the tabs 106 (FIG. 11) of the plug member 98 with gaps 138 located between the bayonet fitting 32 of the ring member 24 and inserts the plug member 98 into the ring member 24 until the rounded wall 110 (FIG. 11) comes into contact with the annular flange 28 (FIG. 1) of the ring member 24 and the seal wall 114 (FIG. 11) and boss 118 (FIG. 11) engage the membrane 20 (FIG. 1). The user then rotates the plug member 98 such that the tabs 106 enter the channels 36 (FIG. 5) of the ring member 24. The resilient membrane 20 urges the plug member 98 upward such that the tabs 106 are secured in the channels 36 by the retaining projections 38 (FIG. 5). When the plug member 98 is in this locked position with respect to the ring member 24, the seal wall 118 forms a seal with the membrane 20 and the boss 118 is positioned to prevent the membrane 20 from moving. In addition, the top portion 102 of the plug member 98 is positioned within the collar 30 of the ring member 24 and does not extend up above the collar 30.

When it is required to disconnect the plug member 98 from the ring member 24, the plug member 98 can be pushed against the reactive force of the resilient membrane 20 such that the tabs 106 can be rotated past the retaining projections 38. The plug member 98 can then be moved outwardly away from the container ring member 24.

Because the plug member 98 is connected to the ring member 24 by the locking interaction between the tabs 106 of the plug member 98 and the channels 36 of the ring member 24 and because the plug member 98 does not extend up above the collar 30 of the ring member 24, the plug member 98 is not easily inadvertently disconnected from the ring member 24. Furthermore, because the plug member 98 provides a seal against the membrane 20 and is connected to the ring member 24 along the collar 32 near the top of the ring member 24, the plug member 98 helps prevent contaminants from getting into the ring member 24 and to the membrane 20.

Figure 13:
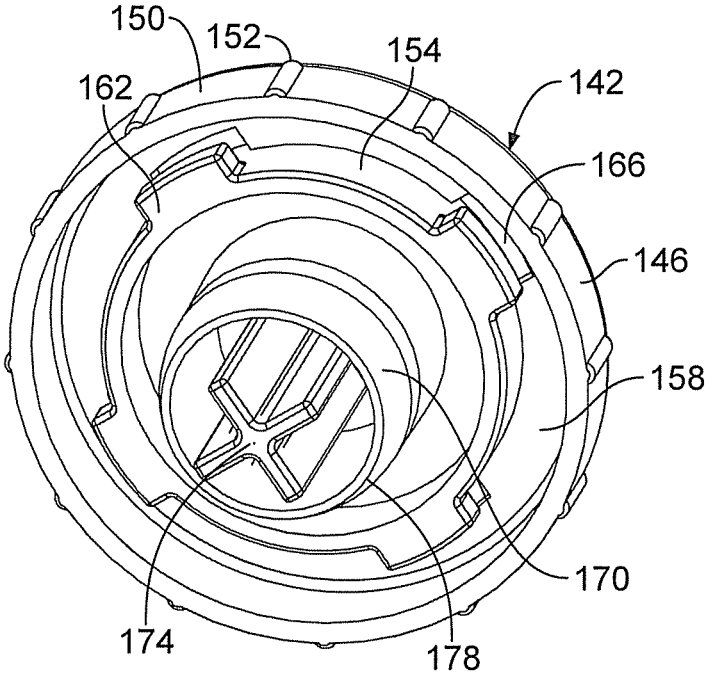
FIG. 13 illustrates a bottom isometric view of a plug member according to an embodiment of the present invention.

FIG. 13 illustrates an alternative embodiment of a plug member 142 for use with the dispensing arrangements 10 of FIGS. 1-7. The plug member 142 is configured to be connected to the ring member 24 (FIG. 1) of the dispensing arrangement 10. The plug member 142 includes a circular top portion 146 with a short downwardly extending cylindrical wall 150. The wall 150 has protrusions 152 extending outwardly therefrom that serve as grips for a user handling the plug member 142. The plug member 142 includes an inner cylindrical portion 154 that extends downwardly from a bottom surface 158 of the top portion 146 and that is positioned radially inward of the wall 150. The inner cylindrical portion 154 includes tabs 162 that extend radially outwardly therefrom. By way of example only, the plug member 142 includes four tabs 162. The top portion 146 includes gaps 166 that are located above the tabs 162. The gaps 166 allow a user to see the tabs 162 through the top portion 146.

A cylindrical seal wall 170 extends downward from the bottom surface 158 of the top portion 146. A cross shaped boss 174 extends downward from the bottom surface 158 of the top portion 146 and is located inside of the seal wall 170. Alternatively, the boss 174 can have other shapes. The boss 174 extends out past a bottom edge 178 of the seal wall 170.

Figure 14:
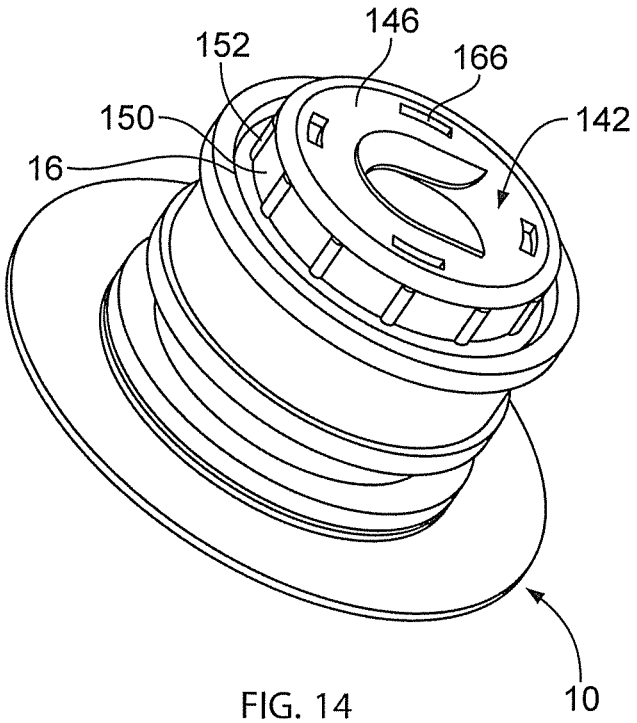
FIG. 14 illustrates a top isometric view of the plug member of FIG. 13 mounted to a dispensing arrangement.

FIG. 14 illustrates the plug member 142 connected to the ring member 24 (FIG. 1) of the dispensing arrangement 10. In operation, a user grips the top portion 146 along the grips 152 in order to connect the plug member 142 to the ring member 24. In particular, looking through the gaps 166 in the top portion 146, the user vertically aligns the tabs 162 (FIG. 13) of the plug member 142 with the gaps 138 (FIG. 12) between the bayonet fittings 32 (FIG. 12) of the ring member 24 and inserts the plug member 142 into the ring member 24 until the wall 150 of the top portion 146 engages the ring part 16 of the dispensing arrangement 10 and the top portion 146 completely covers the ring member 24. The user then rotates the plug member 142 such that the tabs 162 enter the channels 36 (FIG. 5) of the ring member 24. At this point, the seal wall 170 (FIG. 13) and boss 174 (FIG. 13) engage the resilient membrane 20 (FIG. 1), and the membrane 20 urges the plug member 142 upward such that the tabs 162 are held in the channels 36 by the retaining projections 38 (FIG. 5). When the plug member 142 is in this locked position with respect to the ring member 24, the seal wall 170 forms a seal with the membrane 20 and the boss 174 is positioned to prevent the membrane 20 from moving.

When it is required to disconnect the plug member 142 from the ring member 24, the plug member 142 can be pushed against the reactive force of the resilient membrane 20 such that the tabs 162 can be rotated past the retaining projections 38. The plug member 142 can then be moved outwardly away from the container ring member 24.

Because the plug member 142 is connected to the ring member 24 by the locking interaction between the tabs 162 of the plug member 142 and the channels 36 of the ring member 24, the plug member 142 is not easily inadvertently disconnected from the ring member 24. Furthermore, because the plug member 142 covers the ring member 24 and provides a seal against the membrane 20, the plug member 142 helps prevent contaminants from getting into the ring member 24 and to the membrane 20.

Figure 15:
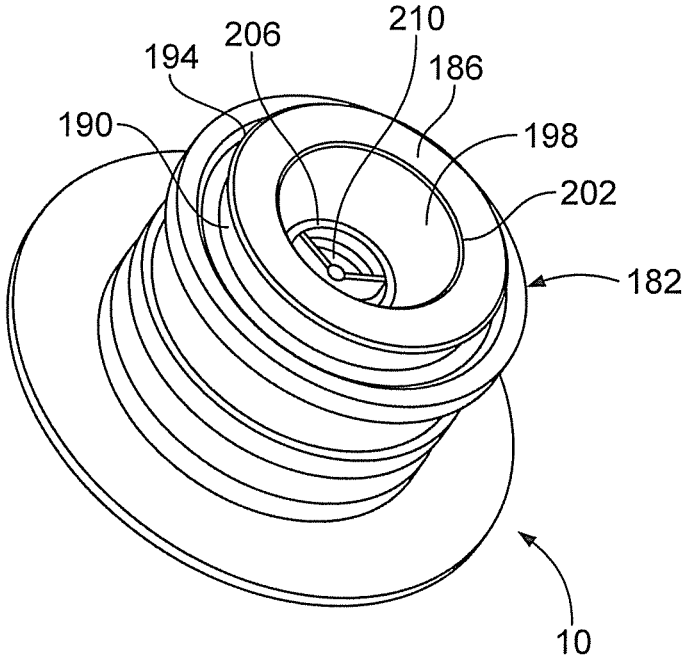
FIG. 15 illustrates a top isometric view of a plug member according to an embodiment of the present invention mounted to a dispensing arrangement.

FIG. 15 illustrates an alternative embodiment of a plug member 182 for use with the dispensing arrangements 10 of FIGS. 1-7. The plug member 182 is configured to be connected to the ring member 24 (FIG. 1) of the dispensing arrangement 10. The plug member 182 includes a circular top portion 186. A cylindrical outer wall 190 extends downwardly from the circular top portion 186 at a point inside an outer edge 194 of the top portion 186. A conically shaped inner wall 198 extends downwardly from an inside edge 202 of the circular top portion 186 to a ledge 206. A bowl shaped base portion 210 extends below the ledge 206. The plug member 182 is mounted to the dispensing arrangement 10 in such a way that the plug member 182 covers the ring member 24.

Figure 16:
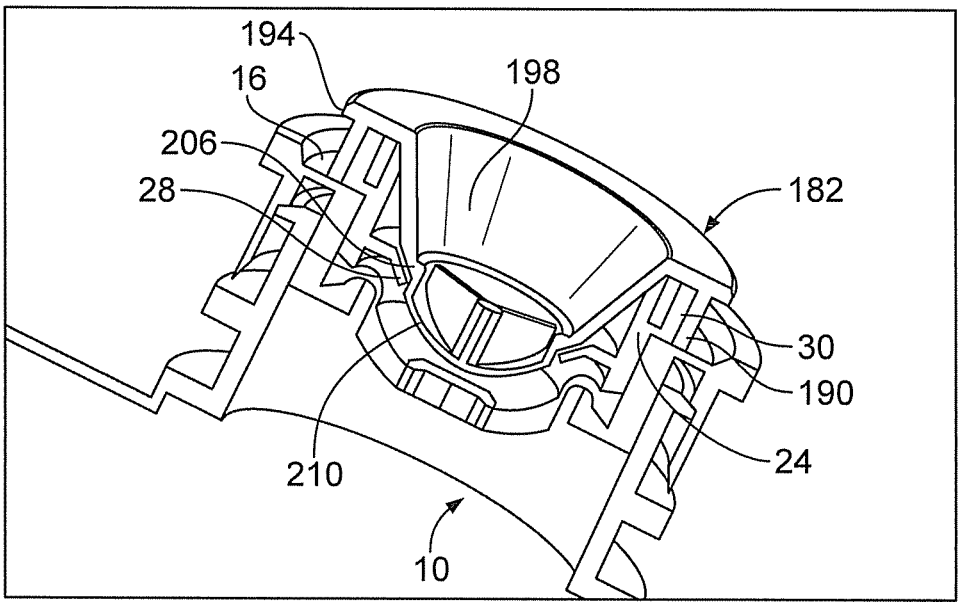
FIG. 16 illustrates a cross sectional side view of the plug member and dispensing arrangement of FIG. 15.

FIG. 16 illustrates a cross-sectional view of the plug member 182 and dispensing arrangement 10 of FIG. 15. In order to mount the plug member 182 to the dispensing arrangement 10, the user grips the plug member 182 along the outer edge 194 and positions the plug member 182 such that the inner wall 198 and base portion 210 of the plug member 182 are inserted into the ring member 24 and the collar 30 of the ring member 24 is received between the outer wall 190 and inner wall 198 of the plug member 182. The plug member 182 is connected to the dispensing arrangement 10 when the annular flange 28 of the ring member 24 creates a press fit with the base portion 210 at a point just below the ledge 206 and the outer wall 190 of the plug member 182 engages the ring part 16. In this way, the plug member 182 is snapably connected to the ring member 24. Alternatively, the plug member 182 can be frangibly connected to the annular flange 28 of the ring member 24.

When it is required to disconnect the plug member 182 from the dispensing arrangement 10, the user grips the plug member 182 along the outer edge 194 and pulls away such that the base portion 210 is snapably disconnected from the annular flange 28 of the ring member 24 regardless of whether the base portion 210 is connected to the annular flange 28 by a press fit or a frangible connection.

Figure 17:
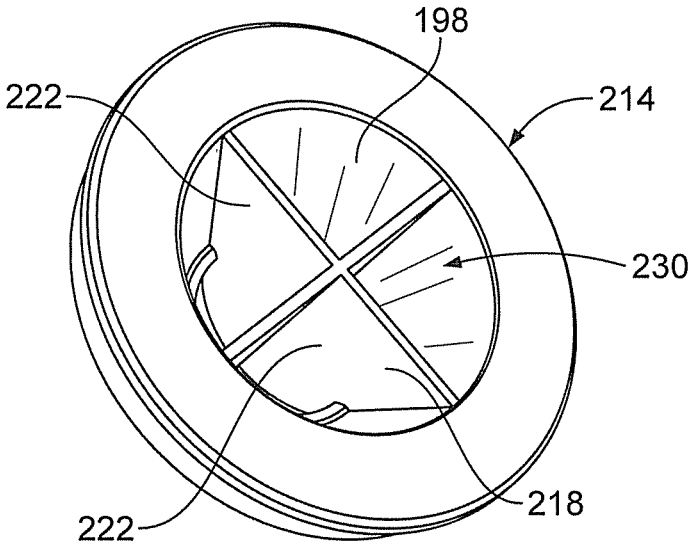
FIG. 17 illustrates a top isometric view of a plug member according to an embodiment of the present invention.
Figure 18:
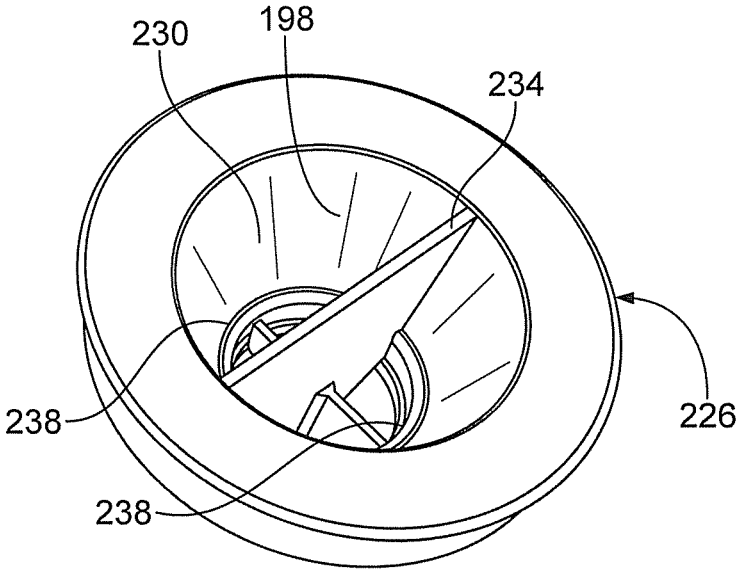
FIG. 18 illustrates a top isometric view of a plug member according to an embodiment of the present invention.
Figure 19:
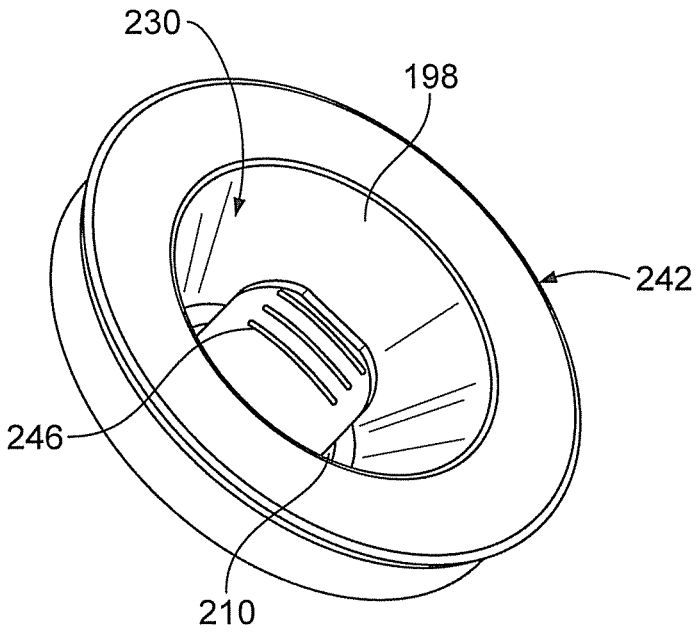
FIG. 19 illustrates a top isometric view of a plug member according to an embodiment of the present invention.

FIGS. 17-19 illustrate variations of the plug member 182 shown in FIGS. 15 and 16. The plug member 214 shown in FIG. 17 includes a cross shaped tab 218 located in a cavity 230 defined by the conical inner wall 198. The tab 218 defines four channels 222 in the cavity 230. In operation, a user can put his or her thumb and fingers into some or all of the channels 222 in order to grip the tab 218 and move the plug member 214.

The plug member 226 shown in FIG. 18 includes a tab 234 that extends between opposite points of the conical inner wall 198 to define two channels 238 in the cavity 230 of the plug member 226. In operation, a user can put his or her thumb and fingers into the channels 238 in order to grip the tab 234 and move the plug member 226.

The plug member 242 shown in FIG. 19 includes a tab 246 that extends upward from the base portion 210 of the plug member 242 and that is not connected to the conical inner wall 198. In operation, a user can put his or her thumb and fingers into the cavity 230 in order to grip the tab 246 and move the plug member 242.

The plug members 214 (FIG. 17), 226 (FIG. 18), and 242 (FIG. 19) are connected to, and disconnected from, the ring member 24 (FIG. 16) in the same way the plug member 182 shown in FIGS. 15 and 16 is. Because the plug members 182, 214, 226, and 242 are connected to the ring member 24 by a press fit or frangible connection, they can be easily connected to or assembled with the ring member 24. Furthermore, the plug members 182, 214, 226, and 242 completely cover the ring member 24 when connected to the dispensing arrangement 10 and, therefore, help prevent contaminants from getting into the ring member 24 and to the membrane 20.

Figure 20:
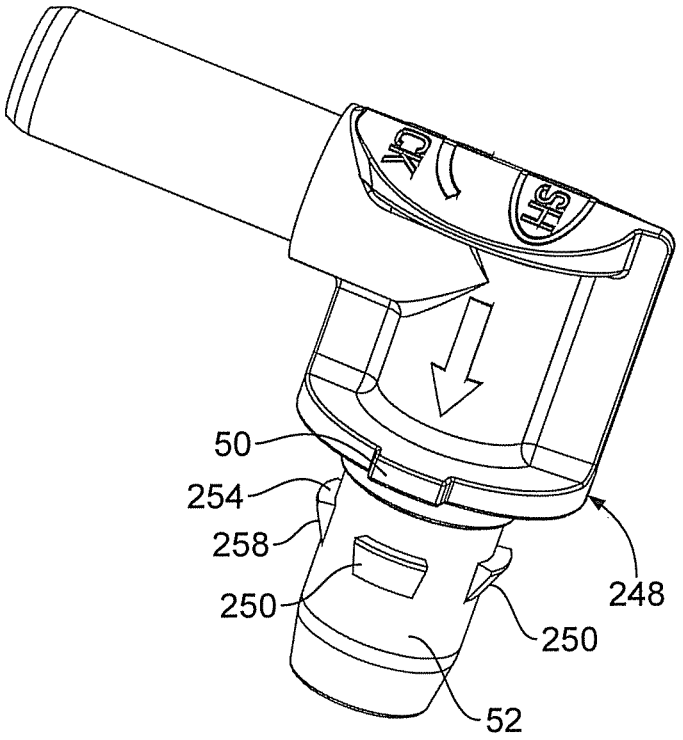
FIG. 20 illustrates an isometric view of a connecting member according to an embodiment of the present invention.

FIG. 20 illustrates an alternative embodiment of a hollow connecting member 248 that can be used with the dispensing arrangement 10 of FIGS. 1-5. Like the connecting member 46 of FIG. 7, the connecting member 248 has tabs 50 that are configured to be locked in the channels 36 (FIG. 5) of the bayonet fittings 32 (FIG. 5) of the ring member 24 (FIG. 5) to secure the connecting member 248 to the ring member 24. The connecting member 248 also includes tapered barbs 250 that extend outwardly from the exterior of the hollow projecting member 52. By way of example only, the connecting member 248 includes four barbs 250. Each barb 250 includes a ledge 254 that extends perpendicularly outward from the hollow projecting member 52, and a wall 258 that tapers downward from the ledge 254 to the projecting member 52.

In operation, the connecting member 248 is connected to the ring member 24 by lockingly engaging the tabs 50 with a pair of bayonet fittings 32 on the ring member 24. Due to the flexibility of the annular flange 28 (FIG. 1) of the ring member 24 and the tapered structure of the barbs 250, as the connecting member 248 is inserted into the ring member 24, the barbs 250 are pushed past and below the annular flange 28. The membrane 20 resistably pushes upward against the projecting member 52 that has been inserted into the ring member 24. However, once the barbs 250 are moved to a position below the annular flange 28, the bottom of the annular flange 28 engages the ledges 254 of the barbs 250 to prevent the barbs 250 from moving further upward. In this way, the barbs 250 lock the connecting member 248 in the ring member 24 even if a user rotates the connecting member 248 to remove the tabs 50 from the channels 36 of the bayonet fittings 32.

Thus, the barbs 250 operate to prevent the detachment of the connecting member 248 from a dispensing arrangement 10 once the connecting member 248 has been attached to the dispensing arrangement 10. This allows the connecting member 248 to be used in single use applications where the user does not need or wish to have the connecting member 248 removed from the dispensing arrangement 10. It also further helps prevent contamination caused by repeated detachment and reattachment of a connecting member to the dispensing arrangement 10.

Figure 21:
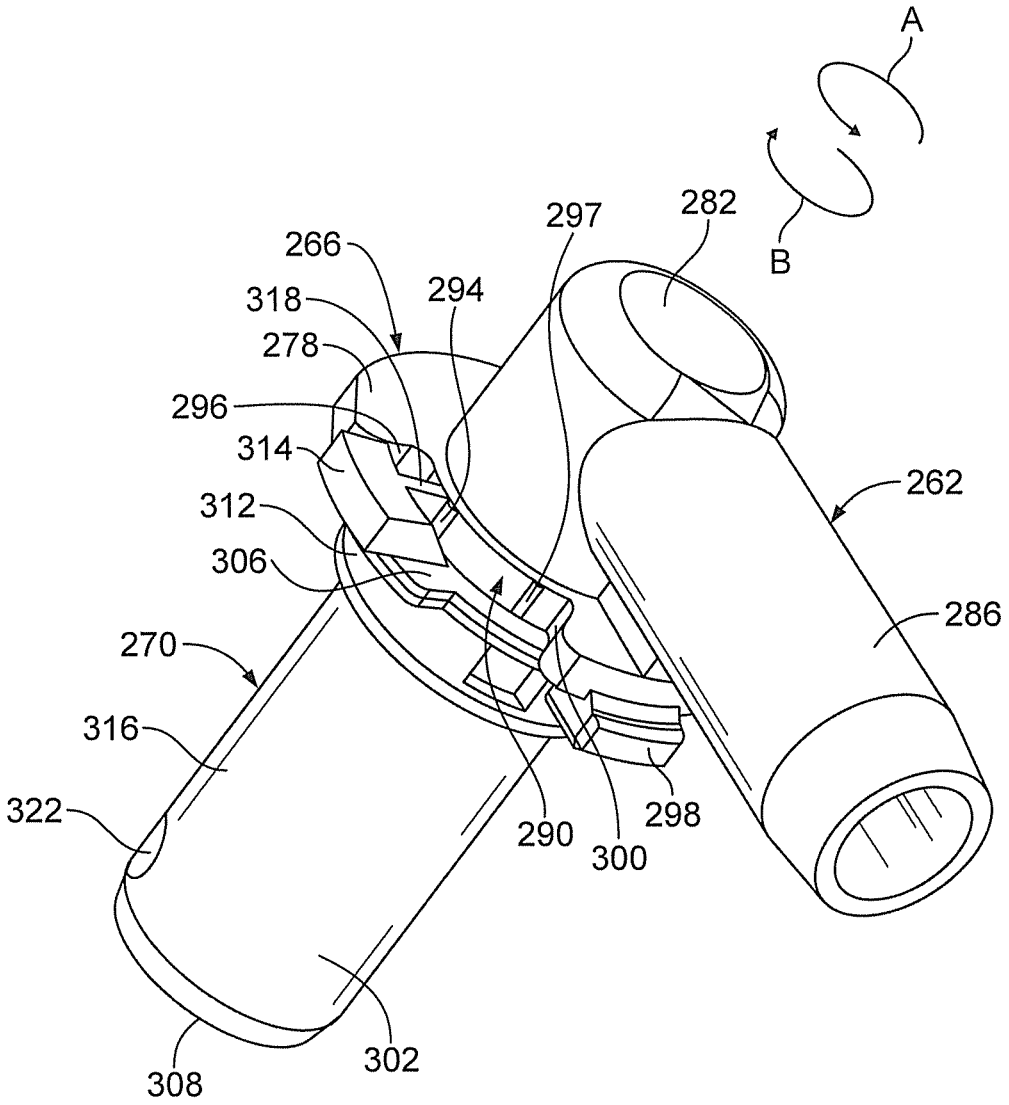
FIG. 21 illustrates an isometric view of a connecting member according to an embodiment of the present invention.

FIG. 21 illustrates another alternative embodiment of a hollow connecting member 262 that can be used with the dispensing arrangement 10 of FIGS. 1-5. The connecting member 262 includes a first body 266 and a second body (or rotor) 270 that are connected to each other. The first body 266 includes a base 278 from which extends a head 282. An outlet tube 286 extends generally perpendicularly from the head 282. The base 278 includes channels 290 on opposite sides thereof, and each channel 290 includes a first end 296 and a second end 300. The channel 290 includes a first boss 294 located near the first end 296 and a second boss 297 near the second end 300. Alternatively, the channel may only include the first boss 294. Two tabs 298 extend below and radially outward from opposite sides of the base 278. The tabs 298 are sized to fit within the channels 36 (FIG. 5) of the ring member 24.

The second body 270 includes a hollow tube portion 302 that extends down from a rim 306 and is closed off by a bottom wall 308. The tube portion 302 has an upper portion 312 and lower portion 316, and the upper portion 312 has a greater diameter than the lower portion 316. The tube portion 302 includes a slot 322 in the lower portion 316 located near the bottom wall 308 and that extends into the interior of the hollow tube portion 302. The rim 306 engages the base 278 of the first body 266 and is secured to the first body 266 by projections 310 (FIG. 22) that extend from the tabs 298 of the first body 266 underneath the rim 306. Two protrusions 314 extend above and radially outward from the rim 306 on opposite sides of the rim 306. Each protrusion 314 is partially located in a corresponding channel 290 of the first body 266 when the first and second bodies 266 and 270 are connected to each other as shown in FIG. 21. Each protrusion 314 includes a prong 318 that extends further into the channel 290.

The first body 266 and the second body 270 can be rotated with respect to each other. The rotation is limited by the protrusions 314 engaging the first and second ends 296 and 300 of the base 278. That is, the first body 266 can be rotated in the direction of arrow A until the protrusions 314 engage the first ends 296 of the channels 290 and can be rotated in the direction of arrow B until the protrusions 314 engage the second ends 300 of the channels 290. Each prong 318 is configured to engage the bosses 294 and 297 in a corresponding channel 290 when the first and second bodies 266 and 270 are rotated with respect to each, other. Each boss 294 and 297 serves as a locking mechanism that resists movement of the prong 318 past the boss 294 and 297. Alternatively, the channels 290 may only include the first boss 294.

In FIG. 21, the protrusion 314 and prong 318 are shown being locked in a first position with respect to the channel 290 by the first boss 294. The protrusion 314 engages or is proximate the first end 296 of the channel 290 when in the first position. Due to the flexible nature of the prong 118 and the boss 294, a user can, with enough force, rotate the first body 266 in the direction of Arrow B such that the prong 318 snapably slides past the boss 294. The first body 266 can be rotated in the direction of Arrow B to a second position where the prong 318 slides past the second boss 297 and the protrusion 314 engages the second end 300 of the channel 290.

Figure 22:
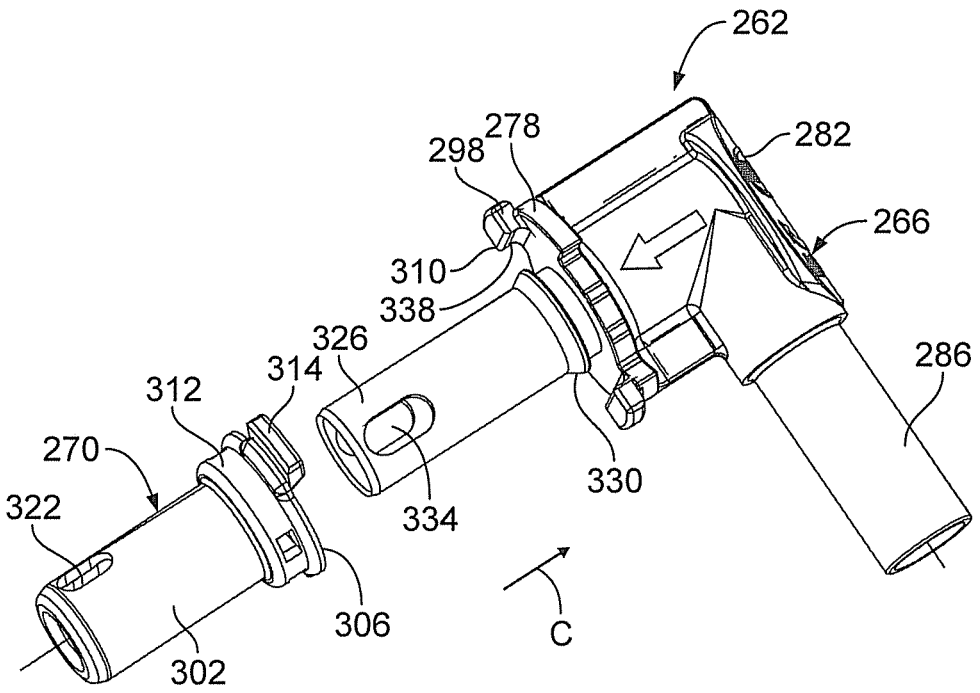
FIG. 22 illustrates an exploded view of the connecting member of FIG. 21.

FIG. 22 illustrates an exploded view of connecting member 262. The first body 266 includes a hollow tube 326 that extends downward from the base 278. The tube 326 is configured to be slidably received in the tube portion 302 of the second body 270. The tube 326 is in fluid communication with the hollow outlet tube 286 extending from the head 282 of the first body 266. A resilient sealing ring 330 is secured to the tube 326 near the base 278. The tube 326 includes slots 334 similar in size and shape to the slot 322 in the tube portion 302 of the second body 270. Projections 310 extend inward from the bottoms of the tabs 298 on the first body 266 to define slots 338 that are configured to receive the rim 306 of the second body 270.

In operation, the first and second bodies 266 and 270 are connected to each other by inserting the tube 326 of the first body 266 into the tube portion 302 of the second body 270 and moving the second body 270 in the direction of Arrow C until the rim 306 of the second body 270 snapably slides past the projections 310 of the first body 266 and is secured in the slots 338 above the projections 310. When the first and second bodies 266 and 270 are connected in this way, the sealing ring 330 on the first body 266 is received in the upper portion 312 of the tube portion 302 of the second body 270 and forms a seal therebetween.

In connecting the first body 266 and second body 270 in the manner described above, the user orients the first and second bodies 266 and 270 such that the prongs 318 (FIG. 21) on the protrusions 314 of the second body 270 are located in the first position as shown in FIG. 21. In such an orientation, the slots 334 of the first body 266 and the slot 322 of the second body 270 are not aligned and do not overlap, and, therefore, fluid does not pass from the outside environment into the hollow tube 326 of the first body 266.

Figure 23:
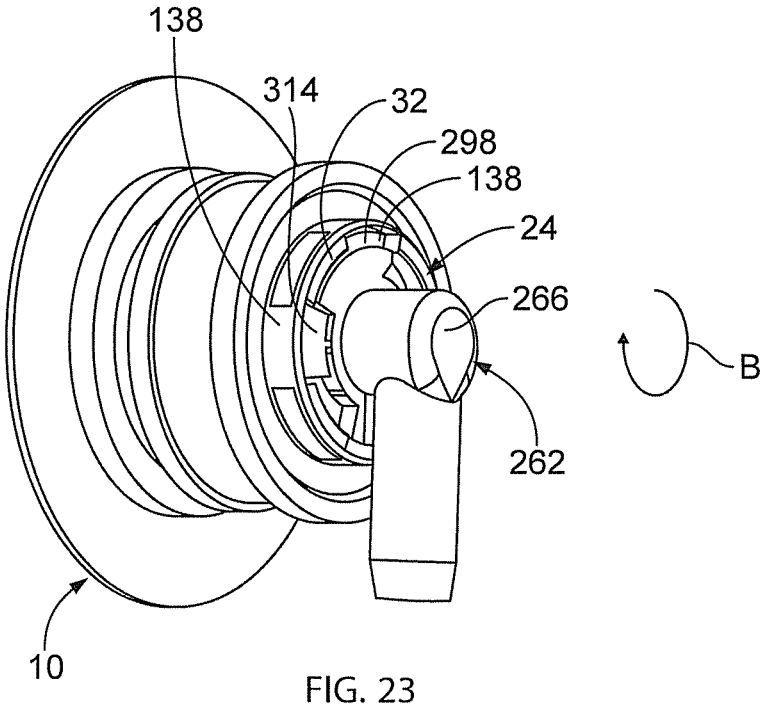
FIG. 23 illustrates an isometric front side view of the connecting member of FIG. 21 inserted into a dispensing arrangement.

With reference to FIG. 23, the assembled connecting member 262 is inserted into the ring member 24 of the dispensing arrangement 10 such that the protrusions 314 are received in a first pair of oppositely aligned gaps 138 between the bayonet fittings 32 of the ring member 24 and the tabs 298 are received in a second pair of oppositely aligned gaps 138. When the connecting member 262 is inserted into the ring member 24 as shown in FIG. 23, the slot 322 (FIG. 22) in the hollow tube portion 302 of the second body 270 extends at least partially past the membrane 20 (FIG. 1) and into the container 12 (FIG. 1) of fluid. The user secures the connecting member 262 to the ring member 24 by rotating the first body 266 of the connecting member 262 clockwise in the direction of Arrow B.

Figure 24:
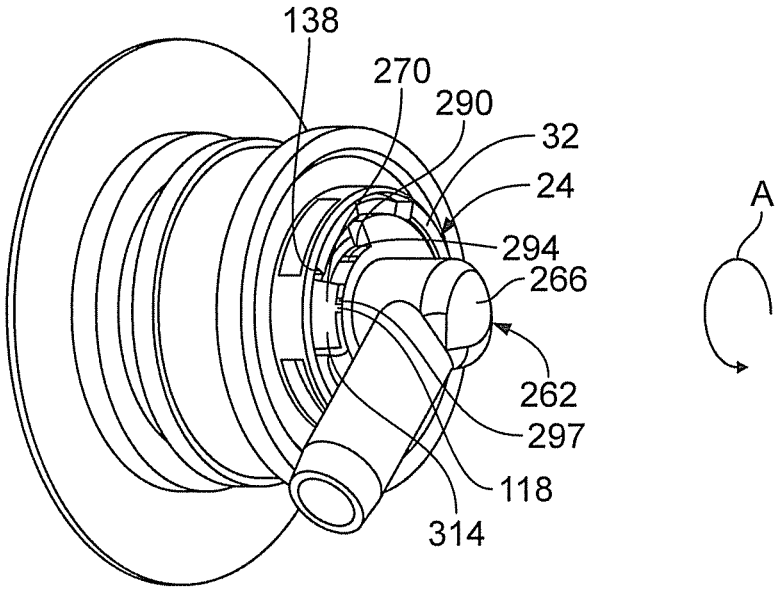
FIG. 24 illustrates an isometric side view of the connecting member of FIG. 21 connected to the dispensing arrangement.

As shown in FIG. 24, by rotating the first body 266 in this direction, the tabs 298 (FIG. 23) become locked in the channels 36 (FIG. 5) of the ring member 24 by the projections 34 (FIG. 5). Moreover, because the protrusions 314 of the second body 270 are held in place in the gaps 138 between the bayonet fittings 32, the user rotates the first body 266 with respect to the second body 270 when rotating the tabs 298 into the channels 36. Specifically, as the first body 266 is rotated clockwise with respect to the second body 270, the prongs 118 snapably pass over the first bosses 294 and then the second bosses 297 until they are moved to a second position in the channels 290 of the first body 266. At the same time the prongs 118 are moving from the first position to the second position, the slots 334 and 322 (FIG. 22) of the first and second bodies 266 and 270 become aligned such that fluid can pass from the inside of the container 12 (FIG. 1) through the slots 322 and 334 and into the hollow tube 326 (FIG. 22) of the first body 266. The connecting member 262 can then dispense fluid from the container 12 in the same way that the connecting member 46 in FIG. 7 does. Alternatively, the first body 266 can operate without the second bosses 297, and the prongs 118 can be maintained in the second position without the presence of the second bosses 297.

When it is required to disconnect the connecting member 262 from the dispensing arrangement 10, the user rotates the first body 266 counter clockwise in the direction of Arrow A with respect to the second body 270 and ring member 24. By doing so, the tabs 298 are moved out of the channels 36 (FIG. 5) of the ring member 24 and the prongs 118 are moved over the first bosses 294 and back to the first position. Rotating the first body 266 counterclockwise with respect to the second body 270 also moves the slots 334 (FIG. 22) of the first member 266 with respect to the slot 322 (FIG. 22) of the second member 270 such that the slots 322 and 334 are no longer aligned or overlapping. With the slots 322 and 334 no longer overlapping, fluid can no longer flow into the hollow tube 326 (FIG. 22) of the first body 266.

Figure 25:
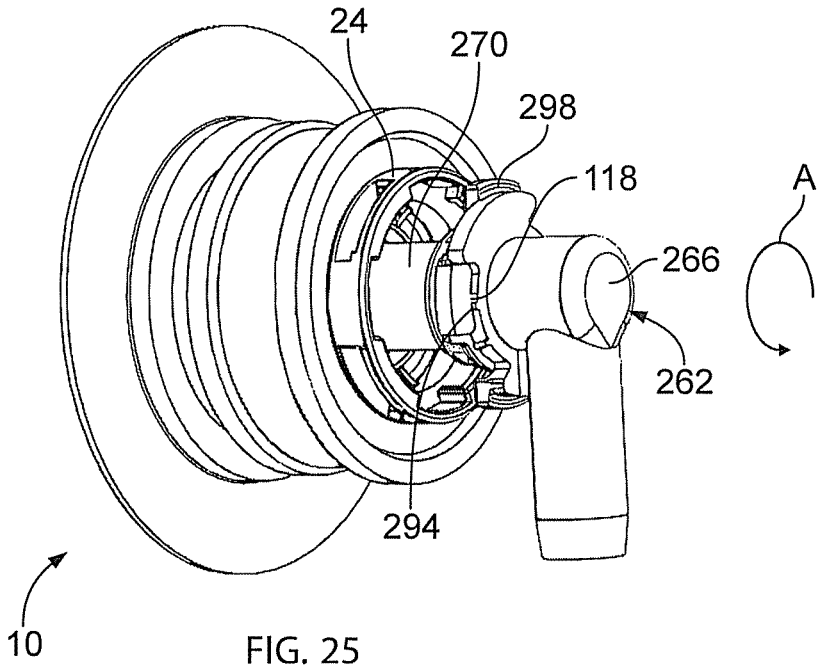
FIG. 25 illustrates an isometric side view of the connecting member of FIG. 21 being detached from the dispensing arrangement.

As shown in FIG. 25, the connecting member 262 is then pulled out of the dispensing arrangement 10 with the prongs 118 located in the first position. Because the passageway into the connecting member 262 that is created by the aligned slots 334 and 322 (FIG. 22) can be closed by rotating the first body 266 with respect to the second body 270 before the connecting member 262 is removed from the dispensing arrangement 10, the amount of fluid that spills from or off of the connecting member 262 as it is removed from the dispensing arrangement 10 is limited. This provides for a more sanitary system for disconnecting a connecting member from a dispensing arrangement 10.

Figure 26:
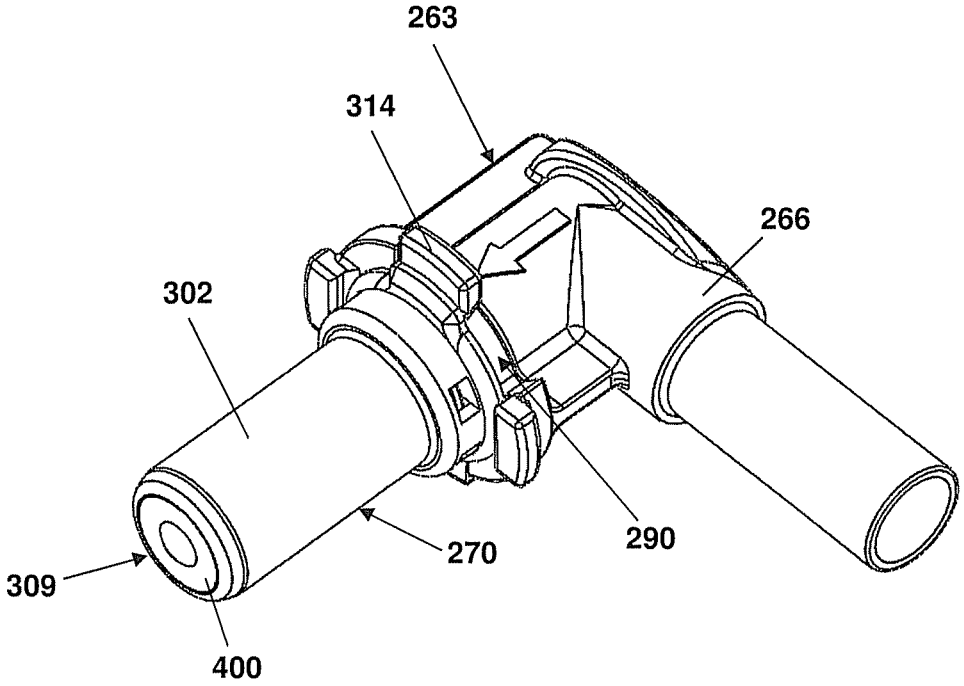
FIG. 26 illustrates an isometric view of a connecting member according to an embodiment of the present invention.

FIG. 26 illustrates another alternative embodiment of a hollow connecting member 263 that can be used with the dispensing arrangement 10 of FIGS. 1-5. The connecting member 263 is similar to the connecting member 262 of FIGS. 21-25 and includes a first body 266 and a second body 270 that are rotatably connected to each other. Unlike the connecting member 262 of FIGS. 21-25, the hollow tube portion 302 of the second body 270 does not include a slot 322. Instead, the hollow tube portion 302 has an open bottom end 309 that allows liquid to pass into the tube portion 302. As shown in FIG. 26, the bottom end 309 is blocked by a circular flexible seal 400 that forms a liquid tight vacuum seal at the bottom end 309 of the tube portion 302 when the protrusion 314 of the second body 270 is locked in the first position with respect to the channel 290 of the first body 266. The seal 400 is connected to the hollow tube 326 (not shown) of the first body 266 of the connecting member 263.

Figure 27:
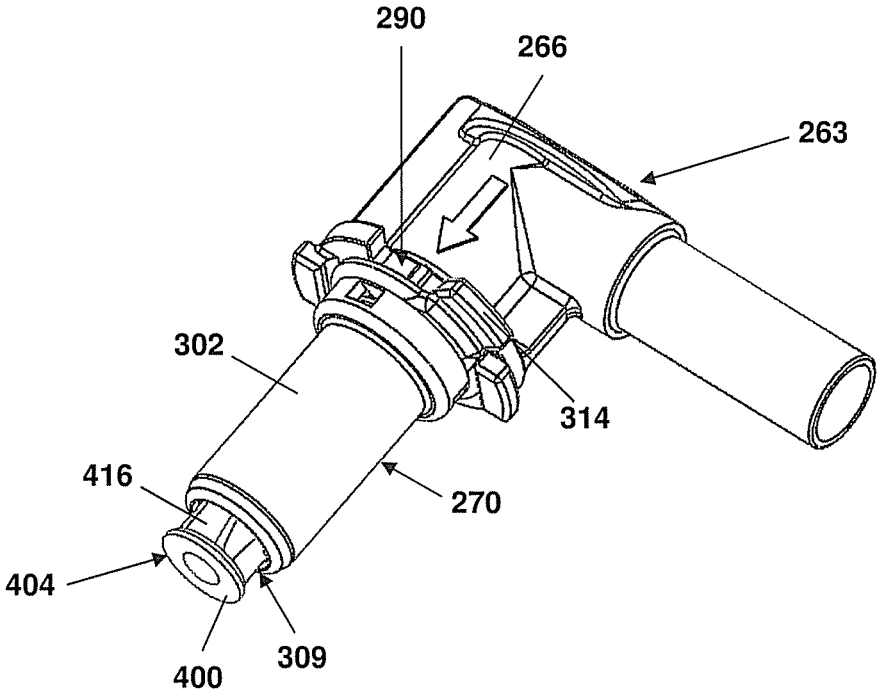
FIG. 27 illustrates an isometric view of the connecting member of FIG. 26 in an open position.

With reference to FIG. 27, the seal 400 can be moved with respect to the bottom end 309 of the tube portion 302 to open the bottom end 309 when the first body 266 is rotated with respect to the second body 270 such that the protrusion 314 of the second body 270 is located at the second position in the channel 290 of the first body 266. When the connecting member 263 is in this position and is connected to the ring member 24 of the dispensing arrangement 10 (FIG. 1), fluid can pass from the inside of the container 12 (FIG. 1) through the opened bottom end 309 and into the hollow tube 326 (not shown) of the first body 266. The connecting member 263 can then dispense fluid from the container 12 in the same way that the connecting members 46 (FIG. 7) and 262 (FIGS. 21-25) do.

Figure 28:
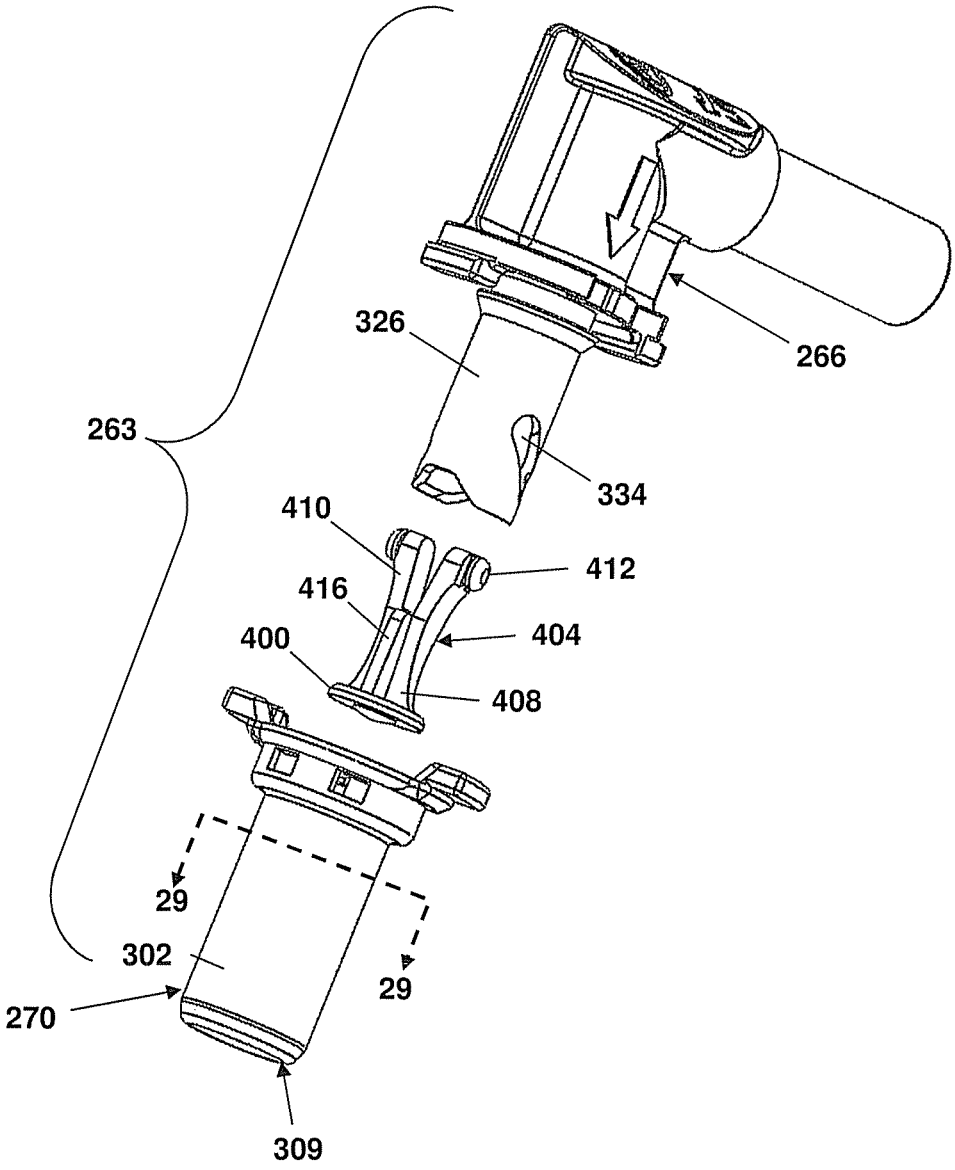
FIG. 28 illustrates an exploded view isometric of the connecting member of FIG. 26.

FIG. 28 illustrates an exploded view of the components of the connecting member 263. The connecting member 263 includes the first body 266, second body 270, and a seal follower 404. The first body 266 is similar to the first body 266 of the connecting member 262 of FIGS. 21-25 except that the tube 326 has curved slots 334. The seal follower 404 includes a body 408 to which the circular flexible seal 400 is attached. Curved arms 410 extend upward from the body 408 and include rounded knobs 412 extending outwardly therefrom. The knobs 412 are configured to be received in and slide in the curved slots 334 in the tube 326 of the first body 266. The follower body 408 also includes vertical tabs 416 extending upward from the seal 400 for the length of the body 408. The body 408 may be made of a hard plastic, and the seal 400 may be made of a flexible elastomeric material such as rubber. By way of example, the seal follower 404 may be made by overmolding the flexible seal 400 on the harder plastic body 408.

Figure 29:
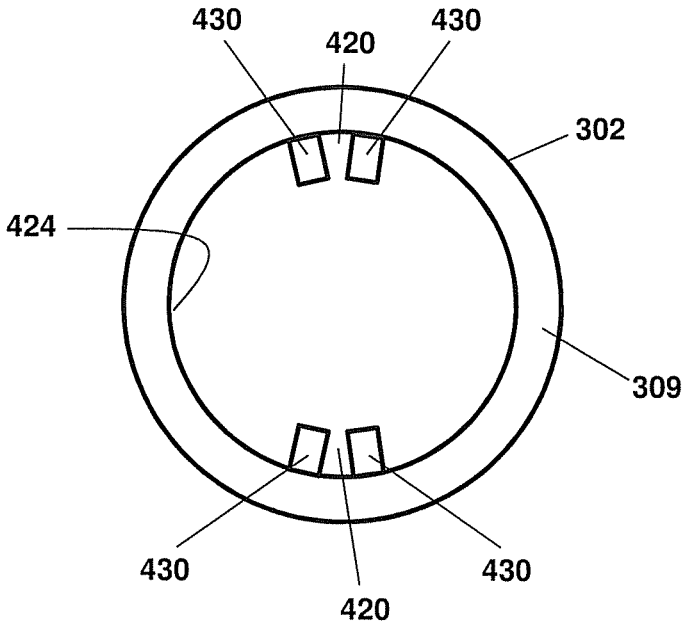
FIG. 29 illustrates a cross-sectional view of the second body of the connecting member of FIG. 28 taken along lines 29-29.

In order to assemble the connecting member 263, the follower 404 is inserted into the bottom end 309 of the tube portion 302 of the second body 270 with the arms 410 going into the tube portion 302 first. In particular, and with respect to FIG. 29, which illustrates a bottom cross-sectional view of the tube portion 302, the follower 404 (FIG. 28) is aligned with the bottom end 309 of the tube portion 302 such that, as the follower 404 is inserted upward into the tube portion 302, the tabs 416 (FIG. 28) of the follower 404 are received in slots 420 defined by protrusions 430 extending inward from the interior wall 424 of the tube 302. By way of example only, the slots 420 and protrusions 430 may extend upward from the bottom end 309 along the interior wall 424 of the tube portion 302 for a distance that is approximately the same as the height of the tabs 416 of the follower 404. The top of the seal 400 (FIG. 28) engages the bottoms of the protrusions 430 to stop further upward movement of the follower 404 into the tube portion 302 during insertion. The slots 420 retain and engage the tabs 416, and thus the follower 404, in the tube portion 302 in such a way that the follower 404 is generally limited to vertical movement within the tube portion 302.

Referring back to FIG. 28, the tube portion 302 of the second body 270 is then slid over the tube 326 of the first body 266, and the second body 270 is connected to the first body 266 in a manner similar to how the second body 270 is connected to the first body 266 of the connecting member 262 of FIGS. 21-25. As second body 270 is slid over the first body 266, the arms 410 of the follower 404 engage the tube 326 of the first body 266 and are flexed inward such that the arms 410 slide into the tube 326. As the arms 410 slide within the tube 326, the knobs 412 encounter the slots 334 and snap into place within the slots 334.

Figure 30:
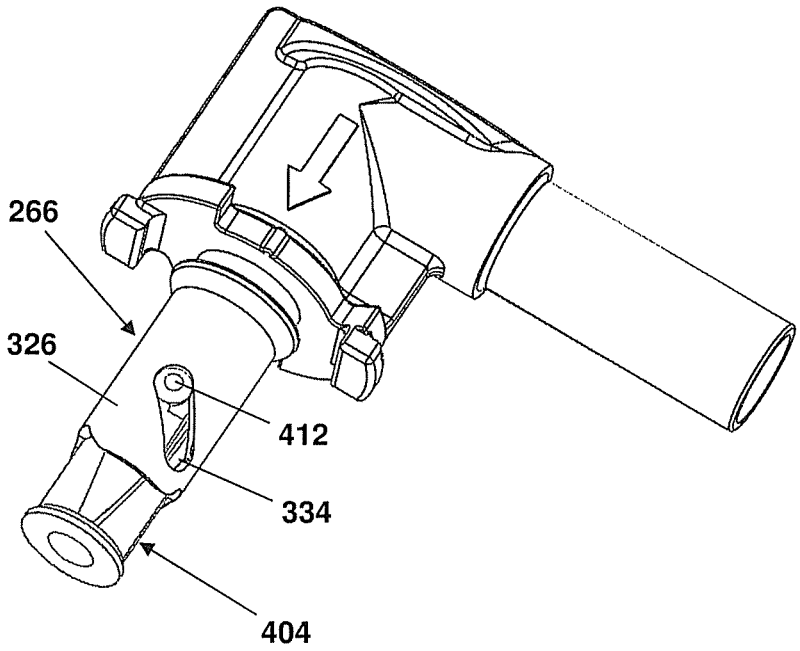
FIG. 30 illustrates an isometric view of the first body and follower of the connecting member of FIG. 26 with the follower in the closed position.
Figure 31:
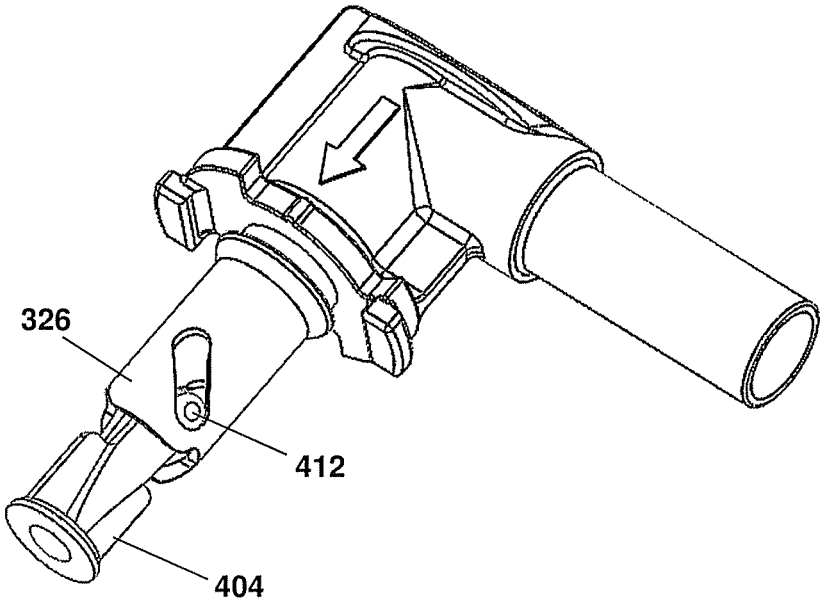
FIG. 31 illustrates an isomeric view of first body and follower of the connecting member of FIG. 26 with the follower in the open position.

FIG. 30 illustrates the seal follower 404 connected to the tube 326 of the first body 266 with the second body 270 not shown. The knobs 412 are positioned in the slots 334 to keep the follower 404 connected to the tube 326. In FIG. 30, the knobs 412 are shown located at the top of the curved slots 334. When the knobs 412 are at the top of the slots 334, the follower 404 is in a first or closed position. FIG. 31 illustrates the seal follower 404 in a second or open position with respect to the tube 326 where the knobs 412 have moved to the bottom of the slots 334 of the tube 326 and the follower 404 extends further out of the tube 326.

Referring back to FIG. 26, the entire assembled connecting member 263 is shown with the follower 404 in the first or closed position and the seal 400 engaging the bottom end 309 of the tube portion 302 of the second body 270 to prevent liquid from entering the tube portion 302 of the second body 270 and the tube 326 of the first body 366.

In operation, the sealed connecting member 263 of FIG. 26 is inserted into the ring member 24 (FIG. 1) of the dispensing arrangement 10 (FIG. 1) in the same way the connecting member 262 of FIGS. 21-25 is such that the hollow tube portion 302 of the second body 270 extends at least partially past the membrane 20 (FIG. 1) and into the container 12 (FIG. 1) of fluid. The user rotates the first body 266 with respect to the static second body 270 in order to secure the connecting member 263 to the ring member 24 in the same way the a user secures the connecting member 262 of FIGS. 21-25 to the ring member 24. This rotation of the first body 266 with respect to the second body 270 causes the follower 404 to move downward to open the bottom end 309 of the tube portion 302 as shown in FIG. 27.

In particular, as the first body 266 is rotated with respect to the static second body 270, the movement of the curved slots 334 (FIGS. 30 and 31) of the first body 266 causes the knobs 414 (FIGS. 30 and 31) to slide down to the bottom of the slots 334 and thus from the closed position to the open position. At the same time, the slots 420 (FIG. 29) inside the tube 302 of the second body 266 engage and guide the vertical tabs 416 of the follower 404 such that the follower 404 moves downward with respect to the tube 302. As the follower 404 moves downward with respect to the tube 302, the seal 400 moves downward away from the bottom end 309 of the tube 302 such that liquid can enter the tubes 302 and 326 and be dispensed from the connecting member 263. In this way, the slots 334 of the first body 226, the knobs 414 and tabs 416 of the follower 404, and the slots 420 of the second body 270 operate as a cam system.

The connecting member 263 can be sealed with respect to the liquid in the container 12 by rotating the first body 266 in the opposite direction with respect to the second body 270 such that the knobs 414 slide back up the slots 334 from the open position to the closed position and the seal 400 is brought back into sealing engagement with the bottom end 309 of the tube 302. The connecting member 263 can then be disconnected from the ring member 24.

Various modifications may be made without departing from the scope of the invention. For instance different mounting arrangements may be provided other than bayonet fittings, and more than two sets may perhaps be provided. Rather than a snap fit the ring member could threadingly engage with the ring part. The connecting member may take a different form. The arrangement could be used other than with bag in box containers for liquid such as milk.

While endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon. In addition, while particular elements, embodiments and applications of the present invention have been shown and described, it will be understood that the invention is not limited thereto since modifications can be made by those skilled in the art without departing from the scope of the present disclosure, particularly in light of the foregoing teachings.

The invention claimed is:

1. A dispensing assembly for a liquid container, comprising:

a ring part configured to be mounted to the liquid container;

a resilient member positioned in the ring part to be in contact with liquid in the liquid container;

a ring member mountable to the ring part to secure the resilient member to the ring part; and a hollow connecting member with an outlet, which connecting member is releasably securable to the ring member, the connecting member including a hollow projecting member which, when the connecting member is secured to the ring member, engages, the resilient member so as to urge an opening in the resilient member to permit the liquid in the container to pass into the connecting member and subsequently out through the outlet, wherein the projecting member of the connecting member includes a first hollow body having a first slot and a second hollow body having a second slot, the second body slidably receives the first body, and, when the connecting member is connected to the ring member, the first body is rotatable with respect to the second body between (i) a first position where the first and second slots overlap and allow the liquid in the container to enter the connecting member, and (ii) a second position where the first and second slots do not overlap.

2. The dispensing assembly of claim 1, wherein the opening in the resilient member automatically closes when the connecting member is detached from the ring member.

3. The dispensing assembly of claim 1, wherein the resilient member is partially scored but not completely perforated before being engaged by the projecting member of the connecting member.

4. The dispensing assembly of claim 1, wherein the resilient member is fully scored before being engaged by the projecting member of the connecting member.

5. The dispensing assembly of claim 1, wherein the ring member includes at least one channel defined by a projection and the connecting member includes at least one tab, and the connecting member is secured to the ring member by rotating the connecting member with respect to the ring member such that the tab is secured in the channel under the projection.

6. The dispensing assembly of claim 1, wherein the ring part is configured to be connected to a spout on the liquid container.

7. The dispensing assembly of claim 1 further comprising a plug that is snapably attachable to and detachable from the ring member when the connecting member is detached from the ring member.

8. The dispensing assembly of claim 7, wherein the plug has a loop that extends upwardly therefrom that can be pulled to detach the plug from the ring member.

9. The dispensing assembly of claim 8, wherein, when the plug is connected to the ring member, the loop extends upwardly and is positioned above a top surface of the ring part but below a top surface of the ring member.

10. The dispensing assembly of claim 8, wherein the loop is connected to a base of the plug by a frangible connection portion.

11. The dispensing assembly of claim 1 further comprising a plug having at least one tab and wherein the ring member includes at least one channel defined by a projection, the plug being secured to the ring member when the connecting member is detached from the ring member by rotating the plug with respect to the ring member such that the tab is secured in the channel under the projection.

12. The dispensing assembly of claim 11 wherein the plug is positioned below a top surface of the ring member when secured to the ring member.

13. The dispensing assembly of claim 11 wherein the plug includes a top portion that covers the ring member when the plug is secured to the ring member.

14. The dispensing assembly of claim 1 further comprising a plug having a base portion, wherein the plug is secured to the ring member when the connecting member is detached from the ring member by an interference fit between the base portion of the plug and an annular flange of the ring member.

15. The dispensing assembly of claim 14, wherein the plug includes a top portion that covers the ring member when the plug is secured to the ring member.

16. The dispensing assembly of claim 15, wherein the plug includes a channel with a tab positioned in the channel that can be pulled to detach the plug from the ring member.

17. The dispensing assembly of claim 1, wherein the connecting member includes at least one barb member on the projecting member and the ring member includes an annular flange and when the connecting member is secured to the ring member, the barb member is positioned beneath the annular flange and the annular flange resists upward movement by the barb member.

18. The dispensing assembly of claim 1, wherein the first and second bodies are configured to engage each other such that the first body can be releasably locked in the first position and releasably locked in the second position.

19. The dispensing assembly of claim 1, wherein the first and second bodies are connected to each other by securing a rim of the second body into a slot of the first body and wherein the rim is rotatable within the slot.

20. A dispensing assembly for a liquid container, comprising:

a ring part configured to be mounted to the liquid container;

a resilient member positioned in the ring part to be in contact with liquid in the liquid container;

a ring member mountable to the ring part to secure the resilient member to the ring part; and a hollow connecting member with an outlet, which connecting member is releasably securable to the ring member, the connecting member including a hollow projecting member which, when the connecting member is secured to the ring member, engages, the resilient member so as to urge an opening in the resilient member to permit the liquid in the container to pass into the connecting member and subsequently out through the outlet, wherein the projecting member of the connecting member includes a first hollow body having a first slot, a second hollow body having a second slot and an opening at a bottom end, and a seal member having a knob positioned in the first slot and a tab positioned in the second slot, wherein the second body slidably receives the first body, and, when the connecting member is connected to the ring member, the seal member can slide along the first and second slots with respect to the first and second bodies, respectively, to (i) a first position where the seal member seals the bottom end of the second body to prevent the liquid from entering the second body, and (ii) a second position where the seal member does not seal the bottom end of the second body and the liquid can enter the second body.

21. The dispensing assembly of claim 20, wherein the opening in the resilient member automatically closes when the connecting member is detached from the ring member.

22. The dispensing assembly of claim 20, wherein the resilient member is partially scored but not completely perforated before being engaged by the projecting member of the connecting member.

23. The dispensing assembly of claim 20, wherein the resilient member is fully scored before being engaged by the projecting member of the connecting member.

24. The dispensing assembly of claim 20, wherein the ring member includes at least one channel defined by a projection and the connecting member includes at least one tab, and the connecting member is secured to the ring member by rotating the connecting member with respect to the ring member such that the tab is secured in the channel under the projection.

25. The dispensing assembly of claim 20, wherein the ring part is configured to be connected to a spout on the liquid container.

26. The dispensing assembly of claim 20 further comprising a plug that is snapably attachable to and detachable from the ring member when the connecting member is detached from the ring member.

27. The dispensing assembly of claim 26, wherein the plug has a loop that extends upwardly therefrom that can be pulled to detach the plug from the ring member.

28. The dispensing assembly of claim 27, wherein, when the plug is connected to the ring member, the loop extends upwardly and is positioned above a top surface of the ring part but below a top surface of the ring member.

29. The dispensing assembly of claim 28, wherein the loop is connected to a base of the plug by a frangible connection portion.

30. The dispensing assembly of claim 20 further comprising a plug having at least one tab and wherein the ring member includes at least one channel defined by a projection, the plug being secured to the ring member when the connecting member is detached from the ring member by rotating the plug with respect to the ring member such that the tab is secured in the channel under the projection.

31. The dispensing assembly of claim 30 wherein the plug is positioned below a top surface of the ring member when secured to the ring member.

32. The dispensing assembly of claim 30 wherein the plug includes a top portion that covers the ring member when the plug is secured to the ring member.

33. The dispensing assembly of claim 20 further comprising a plug having a base portion, wherein the plug is secured to the ring member when the connecting member is detached from the ring member by an interference fit between the base portion of the plug and an annular flange of the ring member.

34. The dispensing assembly of claim 33, wherein the plug includes a top portion that covers the ring member when the plug is secured to the ring member.

35. The dispensing assembly of claim 34, wherein the plug includes a channel with a tab positioned in the channel that can be pulled to detach the plug from the ring member.

36. The dispensing assembly of claim 20, wherein the connecting member includes at least one barb member on the projecting member and the ring member includes an annular flange and when the connecting member is secured to the ring member, the barb member is positioned beneath the annular flange and the annular flange resists upward movement by the barb member.

* * * * *